US008925279B2

(12) United States Patent
Pantelides et al.

(10) Patent No.: US 8,925,279 B2
(45) Date of Patent: Jan. 6, 2015

(54) ANCHORING, SPLICING AND TENSIONING ELONGATED REINFORCEMENT MEMBERS

(75) Inventors: Chris P. Pantelides, Salt Lake City, UT (US); Lawrence D. Reaveley, Draper, UT (US); Clayton A. Burningham, Salt Lake City, UT (US)

(73) Assignee: The University of Utah Research Foundation, Salt Lake City, UT (US)

( * ) Notice: Subject to any disclaimer, the term of this patent is extended or adjusted under 35 U.S.C. 154(b) by 669 days.

(21) Appl. No.: 12/996,759

(22) PCT Filed: Jun. 12, 2009

(86) PCT No.: PCT/US2009/047176

§ 371 (c)(1),
(2), (4) Date: Mar. 16, 2011

(87) PCT Pub. No.: WO2009/152412

PCT Pub. Date: Dec. 17, 2009

(65) Prior Publication Data

US 2011/0197540 A1 Aug. 18, 2011

Related U.S. Application Data

(60) Provisional application No. 61/060,934, filed on Jun. 12, 2008.

(51) Int. Cl.
*E04B 1/38* (2006.01)

(Continued)

(52) U.S. Cl.
CPC ..... *E01D 19/16* (2013.01); *E04C 5/085* (2013.01); *E04C 5/127* (2013.01); *E04G 21/121* (2013.01); *E01D 2101/28* (2013.01)
USPC ..... 52/698; 52/223.1; 52/223.8; 52/223.13; 52/231; 52/705

(58) Field of Classification Search
USPC ..... 52/223.1, 223.6, 223.8, 223.9, 223.11, 52/223.13, 223.14, 231, 295, 414, 432, 52/698, 705
See application file for complete search history.

(56) References Cited

U.S. PATENT DOCUMENTS 2,655,874 A * 10/1953 Swann ..... 410/106
3,006,114 A * 10/1961 Hillberg ..... 52/223.13

(Continued)

FOREIGN PATENT DOCUMENTS

DE 202012002354 U1 * 8/2012
JP 02240308 A * 9/1990

(Continued)

OTHER PUBLICATIONS

Selected documents pertaining to U.S. Appl. No. 61/060,934, filed Jun. 12, 2008 (31 pages).*

(Continued)

*Primary Examiner* — Basil Katcheves
*Assistant Examiner* — Rodney Mintz
(74) *Attorney, Agent, or Firm* — Workman Nydegger

(57) ABSTRACT

Anchoring devices and systems are disclosed for use with elongated reinforcement members such as FRP, SRP, metallic bars, or cables. Such devices and systems impart a compressive stress into a static structure having the elongated reinforcement member running there through or there along. An anchoring system can include an anchor block that includes a front end surface for contacting the static structure, an axial bore for receiving the elongated reinforcement member, and clamping members that work with fasteners to provide a clamping force. The bore may be tapered and the fasteners optionally provide different clamping levels to reduce the stress on the elongated reinforcement member near the front end surface. The disclosed systems also include pre-stressing devices that can be used with the disclosed anchor systems, and that can place a tensile force on the elongated reinforcement members to also impart a compressive force on the static structure.

7 Claims, 13 Drawing Sheets

(51) Int. Cl.

| | |
|---|---|
| ***E01D 4/00*** | (2006.01) |
| ***E04C 5/08*** | (2006.01) |
| ***E01D 19/16*** | (2006.01) |
| ***E04C 5/12*** | (2006.01) |
| ***E04G 21/12*** | (2006.01) |
| *E01D 101/28* | (2006.01) |

(56) References Cited

U.S. PATENT DOCUMENTS

| | | | | |
|---|---|---|---|---|
| 3,091,897 | A * | 6/1963 | Hillberg | 52/223.13 |
| 3,184,219 | A * | 5/1965 | Simms | 254/29 A |
| 3,230,678 | A * | 1/1966 | Eriksson et al. | 52/223.13 |
| 3,249,374 | A * | 5/1966 | Muche et al. | 403/309 |
| D207,871 | S * | 6/1967 | Laurini | D25/199 |
| 3,387,417 | A * | 6/1968 | Howlett | 52/223.13 |
| 3,514,140 | A * | 5/1970 | Ely et al. | 403/301 |
| 3,568,274 | A * | 3/1971 | Hidden et al. | 425/111 |
| 3,595,579 | A | 7/1971 | Benolt | |
| 3,632,724 | A * | 1/1972 | Hilgeman, Jr. | 264/228 |
| 3,647,184 | A * | 3/1972 | Vanderhurst et al. | 254/29 A |
| 3,659,321 | A * | 5/1972 | Laurent | 403/369 |
| 3,703,748 | A * | 11/1972 | Kelly | 403/368 |
| RE27,954 | E * | 4/1974 | Kelly | 403/369 |
| 3,801,052 | A | 4/1974 | Quercetti | |
| 3,877,113 | A * | 4/1975 | Reyes | 24/115 M |
| 4,006,523 | A * | 2/1977 | Mauquoy | 29/452 |
| 4,044,987 | A * | 8/1977 | Tausanovitch et al. | 249/219.2 |
| 4,140,428 | A * | 2/1979 | McLain et al. | 405/259.6 |
| 4,362,421 | A * | 12/1982 | Kelly | 403/369 |
| 4,428,697 | A | 1/1984 | Ruland | |
| 4,469,465 | A * | 9/1984 | Andrus | 403/282 |
| 4,574,545 | A * | 3/1986 | Reigstad et al. | 52/223.6 |
| 4,604,003 | A * | 8/1986 | Francoeur et al. | 405/256 |
| 4,801,764 | A | 1/1989 | Ohlhaber | |
| 5,016,338 | A * | 5/1991 | Rowan, Jr. | 29/423 |
| 5,096,327 | A * | 3/1992 | Ruland | 403/290 |
| 5,251,421 | A * | 10/1993 | Friedrich et al. | 52/749.1 |
| 5,289,626 | A * | 3/1994 | Mochida et al. | 29/452 |
| 5,342,568 | A * | 8/1994 | Yokota | 264/228 |
| 5,467,569 | A * | 11/1995 | Chiodo | 52/713 |
| 5,479,748 | A * | 1/1996 | Siller | 52/231 |
| 5,509,759 | A * | 4/1996 | Keesling | 405/232 |
| 5,560,162 | A * | 10/1996 | Kemeny | 52/167.3 |
| 5,671,572 | A * | 9/1997 | Siller-Franco | 52/223.8 |
| 5,782,043 | A * | 7/1998 | Duncan et al. | 52/167.1 |
| 5,813,181 | A * | 9/1998 | Ashton et al. | 52/291 |
| 5,939,003 | A * | 8/1999 | Crigler et al. | 264/228 |
| 5,983,588 | A * | 11/1999 | Haddock | 52/545 |
| 6,082,063 | A | 7/2000 | Shrive et al. | |
| 6,164,033 | A * | 12/2000 | Haddock | 52/545 |
| 6,561,723 | B2 * | 5/2003 | McCurdy et al. | 403/312 |
| 6,561,780 | B2 * | 5/2003 | Ollendick et al. | 425/111 |
| 6,688,047 | B1 * | 2/2004 | McNichol | 52/25 |
| 6,848,381 | B2 | 2/2005 | Thomas | |
| 7,234,280 | B2 * | 6/2007 | Nieto et al. | 52/223.3 |
| 7,237,366 | B2 * | 7/2007 | Donahey et al. | 52/404.2 |
| 7,296,385 | B2 * | 11/2007 | Andra et al. | 52/223.14 |
| 7,441,380 | B2 * | 10/2008 | Andra et al. | 52/223.13 |
| 7,441,743 | B2 * | 10/2008 | Behlinger et al. | 248/679 |
| 7,658,041 | B2 * | 2/2010 | Andra et al. | 52/223.14 |
| 7,677,522 | B2 * | 3/2010 | Bakos | 248/500 |
| 7,748,972 | B2 * | 7/2010 | Pellicer | 425/111 |
| 7,938,379 | B2 * | 5/2011 | Baten | 248/679 |
| 8,069,624 | B1 * | 12/2011 | Sorkin | 52/223.13 |
| 8,240,096 | B2 * | 8/2012 | Kim | 52/223.14 |
| 8,366,340 | B2 * | 2/2013 | Munakata et al. | 403/255 |
| 8,413,396 | B2 * | 4/2013 | Oliva et al. | 52/309.1 |
| 8,650,819 | B2 * | 2/2014 | Yegge | 52/223.14 |
| 8,702,066 | B2 * | 4/2014 | Steidinger et al. | 254/228 |
| 8,756,885 | B1 * | 6/2014 | Mathews et al. | 52/223.13 |
| 8,800,232 | B1 * | 8/2014 | Keenan | 52/582.1 |
| 8,806,836 | B2 * | 8/2014 | James et al. | 52/698 |
| 2002/0086261 | A1 | 7/2002 | McCurdy | |
| 2002/0088196 | A1 * | 7/2002 | Haddock | 52/543 |
| 2002/0108335 | A1 * | 8/2002 | Haddock | 52/302.1 |
| 2002/0157333 | A1 * | 10/2002 | Kadotani et al. | 52/223.2 |
| 2004/0055233 | A1 * | 3/2004 | Showalter | 52/223.13 |
| 2004/0060256 | A1 * | 4/2004 | Frascari | 52/698 |
| 2004/0065030 | A1 * | 4/2004 | Zambelli et al. | 52/223.13 |
| 2004/0134151 | A1 * | 7/2004 | Haddock | 52/543 |
| 2004/0139670 | A1 * | 7/2004 | Nieto et al. | 52/223.1 |
| 2004/0200186 | A1 * | 10/2004 | Haddock | 52/782.1 |
| 2004/0216403 | A1 * | 11/2004 | Andra et al. | 52/223.1 |
| 2004/0237431 | A1 * | 12/2004 | Park | 52/223.1 |
| 2004/0255530 | A1 * | 12/2004 | Donahey et al. | 52/223.1 |
| 2005/0050832 | A1 * | 3/2005 | Comerford | 52/698 |
| 2005/0102958 | A1 * | 5/2005 | Anderson | 52/698 |
| 2005/0252116 | A1 * | 11/2005 | Maier et al. | 52/223.1 |
| 2006/0272246 | A1 * | 12/2006 | Andra et al. | 52/231 |
| 2007/0101672 | A1 * | 5/2007 | Gunther | 52/698 |
| 2007/0175128 | A1 * | 8/2007 | McCallion | 52/223.13 |
| 2008/0060291 | A1 | 3/2008 | Braun | |
| 2008/0236898 | A1 | 10/2008 | Walker | |
| 2008/0302035 | A1 * | 12/2008 | Shin | 52/223.13 |
| 2008/0302928 | A1 * | 12/2008 | Haddock | 248/205.1 |
| 2009/0205273 | A1 * | 8/2009 | Hayes et al. | 52/223.13 |
| 2010/0037545 | A1 * | 2/2010 | Kekanovic | 52/223.6 |
| 2010/0171016 | A1 * | 7/2010 | Haddock | 248/237 |
| 2010/0229496 | A1 * | 9/2010 | Munakata et al. | 52/705 |
| 2010/0269430 | A1 * | 10/2010 | Haddock | 52/173.3 |
| 2011/0000166 | A1 * | 1/2011 | Jarvis et al. | 52/705 |
| 2011/0000606 | A1 * | 1/2011 | Al-Emrani et al. | 156/160 |
| 2011/0072745 | A1 | 3/2011 | Pantelides | |
| 2011/0094183 | A1 * | 4/2011 | Gasperi | 52/705 |
| 2011/0214366 | A1 * | 9/2011 | Haddock et al. | 52/173.3 |
| 2011/0214367 | A1 * | 9/2011 | Haddock et al. | 52/173.3 |
| 2011/0214368 | A1 * | 9/2011 | Haddock et al. | 52/173.3 |
| 2011/0247292 | A1 * | 10/2011 | Li | 52/698 |
| 2012/0090259 | A1 * | 4/2012 | Muirhead et al. | 52/585.1 |
| 2012/0090260 | A1 * | 4/2012 | Muirhead et al. | 52/585.1 |
| 2012/0227351 | A1 * | 9/2012 | James et al. | 52/705 |
| 2012/0260599 | A1 * | 10/2012 | Zambelli et al. | 52/705 |
| 2012/0267490 | A1 * | 10/2012 | Haddock et al. | 248/221.11 |
| 2012/0297694 | A1 * | 11/2012 | Kim et al. | 52/1 |
| 2012/0304556 | A1 * | 12/2012 | Teller et al. | 52/173.1 |
| 2013/0145711 | A1 * | 6/2013 | Haddock et al. | 52/478 |
| 2013/0152496 | A1 * | 6/2013 | Sinclair | 52/223.13 |
| 2013/0195541 | A1 * | 8/2013 | Pantelides et al. | 403/188 |
| 2013/0232895 | A1 * | 9/2013 | Berset et al. | 52/223.8 |

FOREIGN PATENT DOCUMENTS

| | | | |
|---|---|---|---|
| JP | 04031565 | A * | 2/1992 |
| JP | 10159018 | A * | 6/1998 |
| JP | 02865208 | | 12/1998 |
| JP | 03576338 | | 7/2004 |
| KR | 10-0641403 | | 10/2006 |
| WO | WO 00/61976 | | 10/2000 |
| WO | WO 2009152412 | | 12/2009 |
| WO | WO 2009152412 | A3 * | 3/2010 |
| WO | WO 2012044989 | A1 * | 4/2012 |

OTHER PUBLICATIONS

International Search Report and Written Opinion from PCT/2009/047176, dated Feb. 4, 2010.

International Search Report cited in Application No. PCT/US11/54320 dated Mar. 2, 2012.

International Preliminary Report on Patentability from PCT/2009/047176, dated Dec. 23, 2010.

International Search Report and Written Opinion from PCT/US11/32152 dated Jun. 20, 2011.

U.S. Appl. No. 12/896,335, Sep. 12, 2013, Office Action.

U.S. Appl. No. 12/896,335, Jun. 23, 2014, Notice of Allowance.

* cited by examiner

ANCHORING, SPLICING AND TENSIONING ELONGATED REINFORCEMENT MEMBERS

CROSS-REFERENCE TO RELATED APPLICATIONS

This application claims the benefit of, and priority to, U.S. Provisional Patent Application Ser. No. 61/060,934, filed on Jun. 12, 2008 and entitled "Anchoring and Tensioning System for Fibre Reinforced Polymer Rods, Metallic Bars, and Cables," which application is expressly incorporated herein by this reference in its entirety.

GOVERNMENT RIGHTS

This invention was made with government support under Contract #089113 awarded by the State of Utah Department of Transportation. The Government has certain rights to this invention.

BACKGROUND OF THE INVENTION

1. Field of the Invention

This application relates to anchoring systems, splicing systems and tensioning systems. More particularly, this application relates to systems and methods used to anchor, splice and/or tension elongated reinforcement members such as rods, bars, and cables. More particularly still, this application relates to anchoring, splicing and tensioning systems allowing rods, bars, or cables to be used in reinforcing new or existing structural elements.

2. The Relevant Technology

At present, tens of thousands of bridges in the United States alone have been constructed using technology and materials that are now more than fifty years old. Such bridges may, for example, be made from concrete, masonry, steel, wood, and other materials that have since the time of construction degraded and are now in need of repair before failure occurs. Indeed, many of these bridges are in need of rehabilitation as they are in shear and/or fracture critical states. Other elements besides bridges also suffer from similar conditions, including buildings, pipelines, and other infrastructure.

Various techniques have been used in the past for rehabilitation. For example, mechanical gripping anchors have been developed. These gripping anchors grip a supporting rod and are also connected to a girder or other structural element of the bridge. This provides the bridge with additional support from the rod, and can thus help in repair or rehabilitation of the bridge for shear and flexure enhancement.

Notably, such gripping anchors may be used with, for example, fibre reinforced polymer (FRP) rods. As the gripping anchors grasp on to the FRP rods, they can induce local damage to the rods by, for example, using gripping wedges that induce stress concentrations in the rod. Stress concentrations in the rods can cause failure of the various fibres that make up the rod, thus also initiating premature failure of the rod. As a result FRP rods, which have been manufactured for more than a decade, have not been used widely in post-tensioning or in pre-stressing applications because of the lack of a practical and effective anchor.

When FRP rods are used, they are therefore generally used in a near-surface mount (NSM) technique. Rehabilitation of bridges or other structures using NSM techniques can allow concrete or masonry members to have their flexural and/or shear strength reinforced with FRP rods, and includes cutting a groove in a desired direction in the concrete or masonry surface. The groove may then be filled with epoxy adhesive or a cementitious grout and the FRP rod is placed in the groove. The epoxy or grout flows around the rod to fill in the groove and thereby embeds the FRP rod therein.

Notably, such application can thus be time consuming because of the need to cut the groove in the structural element. Additionally, there is an inherent initial weakening of the structural element by cutting the groove therein. NSM also utilizes epoxy or grout and there is difficulty in controlling the thickness and consistency of the epoxy or grout largely due to this technique being performed in field conditions rather than under testing or manufacturing conditions. Moreover, inasmuch as NSM cuts grooves into the surface of the structural element, it has more limited application for strengthening other elements such as steel structural elements.

Accordingly, what is desired are anchors that can facilitate reinforcement of structural elements, and that are easy to install for existing or new construction even under field conditions, and which is usable in a variety of different applications and with many different construction materials. Preferably, such anchors minimize or eliminate damage due to concentrated stresses while also improving flexural, strength and shear capacity through shear friction. Additionally, it is desired to provide a mechanism for stressing rods, bars, cables, or other supportive elements anchored by such devices so that post-tensioning and/or pre-tensioning may be performed. It is also desired to provide a mechanism for splicing supportive elements for larger spans.

SUMMARY OF THE INVENTION

Example embodiments of the present invention relate to an anchoring system for imparting varying levels of compressive stresses into a structure. For example, the compressive stress imparted could be a nominal amount all the way to the full-buckle strength of the structure and/or reinforcement members of the structure. Thus, the structure may have an elongated reinforcement member running therethrough or therealong. As part of the system, an anchor is described that includes a contact surface for engaging the structure or for engaging a pre-stressing device that is connected to the structure. The anchor includes a bore for receiving the elongated reinforcement member, and also has at least two clamping members. The system can further include an elongated reinforcement member positioned in the axial bore, and a plurality of fasteners can be configured to work with the at least two clamping members to pinch the pair of clamping members and contract the axial bore to create a clamping force on the elongated reinforcement member.

In example embodiments disclosed herein, an anchor system is disclosed and can impart a compressive stress to a static structure. In some example embodiments, such a system includes a front surface that is configured to face a static structure, and can optionally engage against the static structure. At least one bore is included that extends in an axial direction such that it is generally perpendicular to the front surface. A clamp side surface is also included and has multiple clamping holes. Such holes can be formed so that they extend in a direction that is parallel to the front end surface. An axial slit may also extend from the clamp side surface to the bore, and can form two or more clamping members. Fasteners may optionally be placed in the clamping holes and adapted to claim such that clamping members are brought together, and also contract the bore. An elongated reinforcement member such as a rod, bar, cable, or tendon may also be placed within the bore. In some embodiments, the elongated reinforcement member has a diameter or width less than the diameter or width of the bore when the bore is in an unclamped state; however, when the fasteners are tightened, the bore may contract to exert a compressive force around the elongated reinforcement member.

In another embodiment, a method is disclosed for clamping an elongated reinforcement member with an anchor device. In such an embodiment, an anchor may be provided. The anchor may have a front end surface, a cylindrical axial bore, a clamp side surface with holes, and an axial slit along an axial length of the anchor. A plurality of fasteners (e.g., bolts) may be inserted into the holes and the anchor may be slid over the free end of an elongated reinforcement member extending from a structure, and until the front end surface contacts the structure. The clamping bolts may be tightened to constrict the cylindrical bore and secure the anchor to the free end of the reinforcement member. The various fasteners can be tightened independently of each other and independently of a tensile load on the elongated reinforcement member. In one embodiment, the fasteners are tightened such that the fastener nearest to the front end exerts less of a clamping force than other fasteners that are further from the front end.

In another embodiment, a method is disclosed for tensioning an elongated reinforcement member to impart a compressive force. In such an embodiment, an anchor is tightened around an end of a reinforcement member that extends through, adjacent to, and/or along the structure. The elongated member is then tensioned while the reinforcement member is attached to the anchor and sufficiently to cause the anchor to press against a surface of the static structure and provide a compressive force to the static structure. Tensioning may also include changing a distance between the anchor and the static structure.

These and other aspects of embodiments of the present invention will become more fully apparent from the following description and appended claims.

BRIEF DESCRIPTION OF THE DRAWINGS

Features and advantages of the invention will be apparent from the detailed description that follows, and which taken in conjunction with the accompanying drawings, together illustrate features of the invention. It is understood that these drawings merely depict exemplary embodiments of the present invention and are not, therefore, to be considered limiting of its scope. The drawings are generally to scale for example embodiments; however, it should be understood that the scale may be varied and the illustrated embodiments are not necessarily drawn to scale for all embodiments encompassed herein.

Furthermore, it will be readily appreciated that the components of the present invention, as generally described and illustrated in the figures herein, could be arranged and designed in a wide variety of different configurations. Nonetheless, the invention will be described and explained with additional specificity and detail through the use of the accompanying drawings, in which.

DETAILED DESCRIPTION OF EXEMPLARY EMBODIMENTS

Figure 1A:
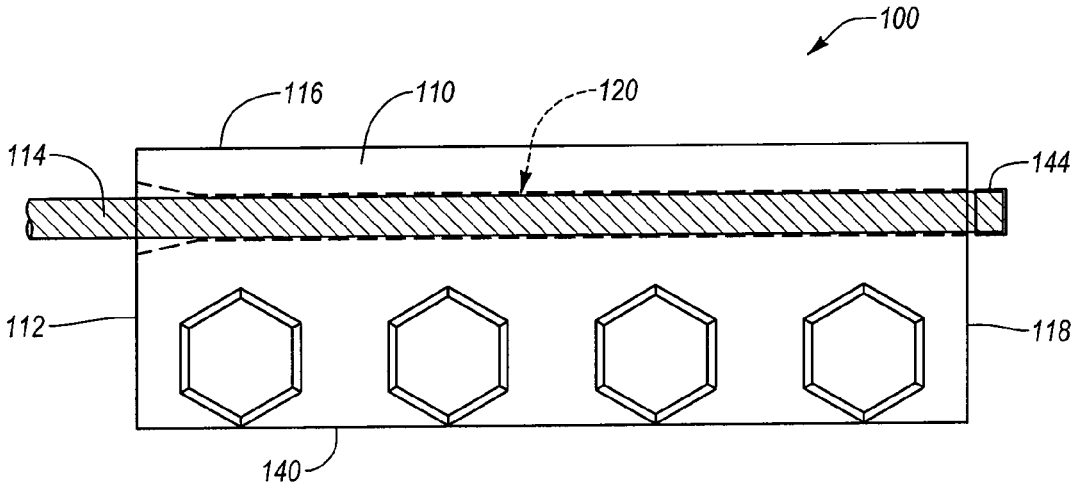
FIG. 1A illustrates a plan view of an anchor for an elongated reinforcement member in accordance with an exemplary embodiment of the present invention.

Reference will now be made to the exemplary embodiments illustrated in the figures, wherein like structures will be provided with like reference designations. Specific language will be used herein to describe the exemplary embodiments, nevertheless it will be understood that no limitation of the scope of the invention is thereby intended. It is to be understood that the drawings are diagrammatic and schematic representations of various embodiments of the invention, and are not to be construed as limiting the present invention. Alterations and further modifications of the inventive features illustrated herein, and additional applications of the principles of the inventions as illustrated herein, which would occur to one skilled in the relevant art and having possession of this disclosure, are to be considered within the scope of the invention. Furthermore, various well-known aspects of at least fiber reinforced polymer rods, steel reinforced polymer rods, metallurgy, and mechanical fasteners are not described herein in detail in order to avoid obscuring aspects of the example embodiments.

In describing and claiming the present invention, the term "elongated reinforcement member" can refer to tendons, cables, rods and other like members which are extended or extendible and used for reinforcing materials over a span or length of a member. Such materials can include, but are not limited to, fibre reinforced polymer (FRP) rods, steel reinforced polymer (SRP) rods, metallic, polymer and composite bars, tendons, and/or cables.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may also be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. Furthermore, such ranges are intended to be non-limiting examples of example embodiments, and should not be construed as required for all embodiments unless explicitly recited as such in the claims.

Illustrated in, and described relative to, FIGS. 1A through 10 are various exemplary embodiments of an anchoring, splicing and/or tensioning system for elongated reinforcement members such as FRP rods, SRP rods, metallic bars or cables. The illustrated system can be used to anchor and tension FRP and SRP rods, metallic bars or cables used to supplement or replace steel reinforcement in static structures made from concrete and other rigid construction materials, such as masonry, steel and wood. The present invention can apply to elongate reinforcement members used in new construction as well as the repair/rehabilitation of existing reinforced/pre-stressed concrete, steel, masonry or timber elements such as beams, columns and walls. The present invention also has application in seismic connections for new reinforced/pre-stressed materials in buildings, bridges, pipelines, and the like. It should also be noted that the phrase "static structure" is used broadly to represent any structure that could be reinforced by an elongated reinforcement member, and is not limited to buildings, bridges, pipelines, etc. Indeed, a moving structure could also be a static structure. For example, a moving structure may have an anchoring device attached thereto, such that there is no relative motion between the moving structure and the anchor, thereby causing the structure to be static in relation to the anchor.

The anchoring, splicing, and tensioning system of the present invention can be used to secure an elongated reinforcement member to a static structure through, along, or around which it runs, and to transfer a compressive stress into the same structure upon tensioning of the elongated reinforcement member. The static structure can be any building, wall, column, beam, foundation, roof, pipeline, infrastructure component, or other structure, and may be made from concrete, steel, masonry, wood or other similar building materials. Generally, an elongated reinforcement member will be installed in the structure in such a way that at least one end of the elongated reinforcement member extends outwardly from a face, or contact surface, of the static structure. The opposite end of the elongated reinforcement member can be attached to the opposite side of the structure with the same or similar anchoring system, or can be secured within or inside the structure itself. In the alternative, the elongated reinforcement member can be wrapped around an outside surface of the static structure, with the far end either attached to another surface, or wrapped all the way around the structure, such as a column, to be secured against the first end. In both interior and exterior configurations, the middle section of the elongate reinforcement member passing through the inside or along the outside perimeter need not be directly attached to the static structure, but may be at least partially free to move and stretch along its length independent of the static structure.

The elongated reinforcement member can be installed horizontally, vertically or at any angle depending on the particular structural design. With the elongate reinforcement member running horizontally, as may be common, the anchor can press against a vertical contact surface such as the face or end of an element of a structure such as a wall, beam, girder, and the like. The elongate reinforcement member could also be run all or a portion of the height of a vertical structure, with one end secured within the foundation and the free end extending vertically out of a top, horizontal contact surface. The anchoring system can be placed to press directly against the contact surface, or a plate or tensioning device with a through hole or slot for the elongate reinforcement member can be positioned between the anchor and the contact surface of the static structure.

After both ends of the tendon are secured to the static structure, the elongate reinforcement member can optionally be tensioned and/or stretched with a variety of methods, resulting in an equal and opposite reaction force applied to the static structure which acts to compress the portion of the static structure located between the two elongate reinforcement member attachment points. Through the use of multiple elongate reinforcement members spaced at intervals along the static structure, or even multiple tendons running in two directions to form a plane, the structure can be compressed at multiple locations and/or in two or more directions to form a stronger, more solid and unified static structure.

Now turning to FIGS. 1A to 4B, specific examples of various anchor devices will be described. It will be appreciated that the described and illustrated embodiments are merely exemplary and include various features and/or components that can be combined in different embodiments. Thus, no feature or component should be interpreted to require use with only one or more other components or features.

Figure 1B:
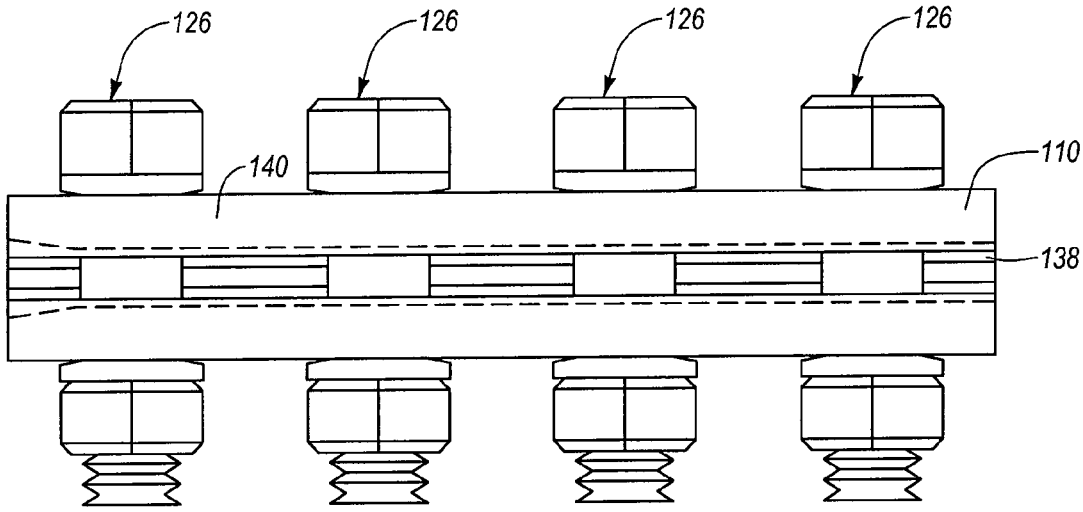
FIG. 1B illustrates a side view of the anchor illustrated in FIG. 1A.
Figure 1C:
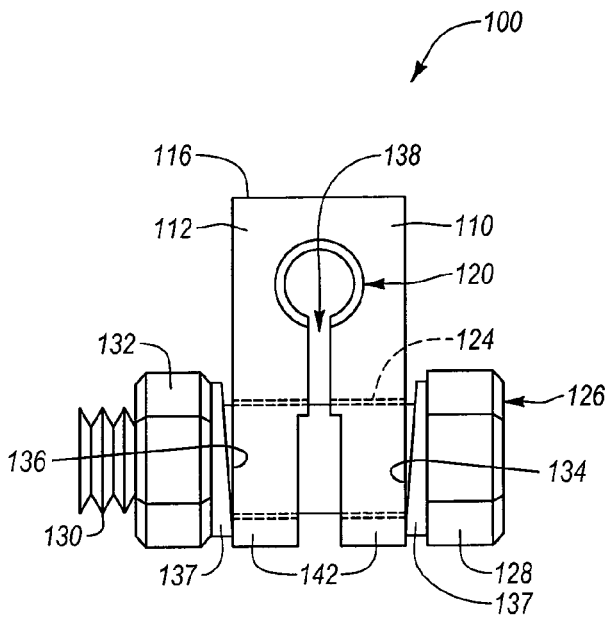
FIG. 1C illustrates a front elevation view of the anchor illustrated in FIG. 1A.

As illustrated in FIG. 1A-1C, an anchor device 100 according to some example embodiments of the present invention can include an anchor block 110 having a generally rectangular configuration in each of the horizontal (x), vertical (y), and axial (z) directions. For the purposes of this description, the plane formed by the x-y axis of anchor block 110 can be defined as coplanar with the contact surface of the static structure against which the anchor block will eventually press, and the z-direction can be defined as perpendicular to the plane of the contact surface which could be co-planar or curvilinear.

In an alternative embodiment, a front end surface 112 can be oriented transverse to the contact surface, such as when an elongate reinforcement member 114 is wrapped around the perimeter of the static structure and parallel to the contact surface. In this orientation the system and principles of attaching anchor 100 to elongate reinforcement member 114 is the same with the exception that a side surface 116 of the anchor block presses against the static structure, instead of front end surface 112.

In some example embodiments, anchor block 110 can have a substantially planar, front end x-y surface 112 configured to face the contact surface of the static structure, and also have a back end, non-contact surface 118. A cylindrical axial bore 120 having one or more bore diameters can be formed in anchor block 110, and may extend generally perpendicular to the plane of front end surface 112. Bore 120 may extend through all or a portion of anchor block 110. For example, in the embodiment illustrated in FIGS. 1A and 1B, bore 120 extends through all of anchor block 110, and runs from front end surface 112 to back end surface 118. Bore 120 may be positioned as desired and suitable for the particular application. Bore may thus be centered within anchor block 110, or may be offset from the centerline of anchor block 110, as illustrated in FIGS. 1A-1C. In the illustrated embodiment, for instance, anchor block 110 is centered relative to an x-axis, while being offset relative to the y-axis.

As best shown in FIG. 1C, one or more holes 124 may also be formed in anchor block 110, and can be used to provide for axially-stacked clamping forces. In the illustrated embodiment, for instance, there are four holes 124 that are aligned with four mechanical fasteners 126. The mechanical fasteners 126 can run through holes 124 and parallel to the plane of front end contact surface 112.

As best shown in FIGS. 1A and 1B, in which mechanical fasteners 126 are substantially centered within holes 124, the various holes 124 may be substantially evenly distributed along the axial length of anchor block 110. This can be desirable to, for example, evenly distribute the clamping force along the length of the elongated reinforcement member 114 within bore 120. In other embodiments, however, it may not be desired to evenly distribute the clamping force along the length of elongated reinforcement member 114 and anchor body 110. For instance, as described hereafter, it may be desirable to have a reduced clamping force at or near front surface 112, with increasing clamping force towards back-end surface 118. As a result, holes 124 may optionally be distributed unequally along the axial length of anchor block 110, mechanical fasteners 126 may be tightened to provide different clamping forces, or other mechanisms may be used to ensure different clamping forces are provided.

Any suitable mechanical fastener 126 may be utilized in connection with the various embodiments described herein. In the illustrated embodiment, for instance, mechanical fastener 126 includes a bolt 128 that has threads 130 so as to allow a nut 132 to be fastened thereto. As nut 132 is then secured and tightened relative to bolt 128, nut 132 and bolt 128 exert a clamping force that is compressive between clamp side surfaces 134, 136 of anchor block 110.

As further illustrated, the example embodiment of mechanical fastener 126 may also include multiple washers 137. In the illustrated embodiment, one washer 137 is positioned between the head of bolt 128 and clamping surface 134. A second washer 137 is positioned between side surface 136 and nut 132. Such washers 137 provide the ability to spread the forces applied to anchor body 110 by mechanical fastener 126, thereby reducing stress concentrations by substantially evenly distributing the forces and stress.

As best illustrated in FIGS. 1B and 1C, an axial slit 138 may also extend along all or a portion of the axial length of anchor block 110. In the illustrated example, for instance, axial slit 128 extends along the entire axial length of anchor block 110. In addition, in this illustrated embodiment, axial slit 138 extends along a portion of the height of anchor block 110. For instance, axial slit 138 extends, in this embodiment, along approximately the centerline of front-end surface 112 and from axial bore 120 to the intersection between front-end surface 112 and side surface 140. As can be seen, such an axial slit thus creates a pair of clamping members 142 that can be compressed together as mechanical fastener 126 is tightened.

In the exemplary embodiment, axial slit 138 is tapered such that its width varies along its height. Specifically, FIG. 1B illustrates that axial slit 138 has a substantially constant width across its length, while FIG. 1C illustrates that axial slit 138 has two different widths along its height. In particular, axial slit 138 near side surface 140 extends partially towards axial bore 120, and then decreases in size. Notably, the illustrated embodiment thus includes a stepped-taper design to axial slit 138; however, this is merely exemplary. In other embodiments, axial slit 138 may have a straight taper, may have more than two widths, may be parabolic or otherwise increase and then decrease in size, or may have substantially no taper. Moreover, while axial slit 138 extends all the way from bore 120 to side surface 140, in other embodiments it may only extend partially therebetween. For example, an exemplary axial slit may extend from side surface 140 towards bore 120, but without reaching bore 120.

Illustrated in FIGS. 1A-1C is another aspect of example embodiments of the present invention, in which the end of the axial bore 120 proximate the front-end surface 112 has been configured with an expanded tapered opening. Such a configuration is optional but may make it easier to insert elongated reinforcement member 114 and/or to allow a reduction in the stress of the elongated reinforcement member 114 as it is clamped within bore 114, and/or provide a greater tolerance in the lateral alignment of the anchor block 110 to the elongated reinforcement member 114. As shown, the taper can include a smooth profile, although in other embodiments it may include a stepped profile. Moreover, while the illustrated embodiment shows a taper that extends only a fraction of the axial length of anchor block 110, in other embodiments there may be no taper, the taper may extend the entire length of anchor block 110, or may extend a greater or lesser length within anchor block 110.

As described herein, two clamping members 142 can be pulled together using mechanical fasteners 126 inserted through the four clamping holes 124 and secured with nuts 132 and washers 137. In one aspect of the present invention, the washers 137 positioned between the clamping bolts 128 and nuts 132 and the clamping members 142 can be configured with a taper to maintain a distributed circumferential surface contact between the clamping bolts 128 and the clamping members 142 in the closed position. This helps to reduce bending stresses on the clamping bolts during tightening. Furthermore, the means used to close and lock the axial bore 120 may not be limited to bolts, but can include any clamping device that can reliably and consistently pull, push or secure the two clamping members together, such as screws, lever cams, locking pins, rivets or comparable fasteners, U-clamps or similar external clamping devices, or even welding or other like means for permanently joining the two clamping members 142 together after they have been pulled/pushed together with another clamping device. Additionally, while washers 137 are illustrated as being tapered, in other embodiments they may be straight/flat washers, C-washers, beveled washers and the like. Furthermore, while the illustrated embodiment includes two washers 127 in each mechanical fastener 126, in other embodiments there may be more or fewer washers, and even may be embodiments where no washers are utilized.

In the exemplary embodiment shown in FIGS. 1A-1C, anchor block 110 can have dimensions of approximately two inches in the y-direction, one inch in the x-direction, and six inches in the z-direction. As described hereafter, the two-by-one inch plane forming front end surface 112 can apply a compressive load to the contact surface of a static structure; however, nothing should be construed from the drawings and specification that these dimensions or relationships are fixed. For example, anchor block 110 could have a generally hemispherical or ellipsoid configuration, in which case the flat face of the anchor block corresponding with the x-y plane can be a round or elliptical contact face which applies the compressive force against the contact surface of the fixed body. In other embodiments, side surfaces 116, 118 may apply the compressive force against the contact surface of the fixed body.

The anchor block can slide over an elongate reinforcement member and has a diameter smaller than the unclamped diameter of bore 120. The elongate reinforcement member can slip into axial bore 120 as the front end face 120 abuts against the contact surface of the static structure, or as will discussed in more detail hereinafter, against an intermediate plate or prestressing device disposed between anchor block 110 and the static structure. The four mechanical fasteners 126, complete with clamping bolts, washer and nuts, can be inserted into the clamping holes 124 and can be tightened to pinch closed the pair of clamping members 142, which causes the diameter of the axial bore 120 to shrink and clamp around the elongate member and form a clamping force that secures anchor block 110 to elongate reinforcement member 114.

After the anchor block 110 has been secured to the elongate reinforcement member 114, the elongate reinforcement member 114 can be tensioned axially in a variety of manners to create a tensile stress within the elongate reinforcement member 114 and a corresponding compressive stress on the static structure. It is a feature of some example embodiments that the application of the clamping force between anchor block 112 and elongate reinforcement member 114 can vary between the various mechanical fasteners 126, and thus be independent of the application of the axial tensile load on elongate reinforcement member 114. Unlike previous anchoring methods in which the clamping force is applied simultaneously with the tensile force through a wedge- or truncated cone-shaped structure, the independent application of the variable clamping force between mechanical fasteners 126 provided by example embodiments described herein allows one to better control the amount and distribution of the clamping stresses imposed on elongate reinforcement member 114 . For example, a distal or back-end fastener can be tightened further than a proximal bolt closer to front side 112 sufficient to provide significant mechanical tightening which could be damaging if applied to the proximal fastener. Whereas the wedge-shaped structures found in the prior art tend to concentrate the clamping forces at the forward tip of the wedge or truncated cone, the present invention allows for a substantially even distribution of stress along the entire length of the axial bore 120, leading to improved performance, longer life and lower costs over prior elongate reinforcement member 114 anchoring and tensioning systems.

The reduction of concentrated clamping forces can be particularly desirable when FRP rods are used, as the concentrated clamping forces can cause outer fibers to break, thereby reducing the effectiveness and life of the FRP rod. One aspect of the example embodiments herein is that inasmuch as the various mechanical fasteners can be tightened independently of the axial forces on elongate reinforcement member 114, the forces can be selectively applied so as to not only reduce the stress at front-end 112 where failure is most likely to occur, but also to evenly distribute the forces around the surface of elongate reinforcement member 114. Such reductions of stress concentrations can occur due to the tapered design of bore 120 at front-end surface 112, setting different clamping pressures at mechanical fasteners 136, or a combination of the above.

As has been noted above, it may be desirable to tighten the mechanical fastener 126 nearest front end 112 to a pressure less than that of the remaining mechanical fasteners 126, In one embodiment, the clamping pressure at the front-most mechanical fastener 126 may be set to a pressure approximately two-thirds that of the second mechanical fastener 126. Of course, other pressures may be used an in other example embodiments, the pressure at the front-most mechanical fastener 126 is between one-quarter and three-quarters that oat the second mechanical fastener 126. The remaining mechanical fasteners may also have pressures similar to that of the second mechanical fastener 126 or may have different pressures (e.g., increasing pressure as the distance from front-end surface 112 increases).

The clamping force between anchor block 110 and elongate reinforcement member 114 can be created or applied in different manners. As described above, for instance, the application force can be directly applied by simply tightening the clamping bolts 128 to close the axial bore 120 and pinch the elongate reinforcement member 114 until enough clamping force has been generated to secure the anchor block 110 to elongate reinforcement member 114. In an alternative embodiment of the present invention, a deformable sleeve (not shown) can be interposed between the inner surface of axial bore 120 and elongate reinforcement member 114 to better distribute the clamping stress across the interface between the two bodies when mechanical fasteners 126 are tightened at different clamping stresses. The deformable sleeve can be made from a variety of materials compatible with the elongate reinforcement member 114 and the anchor block 110, such as malleable metals, flexible polymers, textiles, or composites thereof. Suitable deformable materials can include, but are not limited to, soft metals, such as copper or resins such as epoxies. When a deformable sleeve is used, the diameter of the axial bore can be made larger to accommodate both the elongate reinforcement member 114 and the thickness of the deformable sleeve.

In another aspect of the present invention, instead of, or in addition to, a deformable sleeve, an adhesive material can be interposed between the inner surface of the axial bore and the elongate reinforcement member 114 and allowed to cure and form a chemical bond between the anchor block and the elongate reinforcement member 114. The cured adhesive material can be an epoxy, industrial glue or similar adhesive which can be materially compatible with both the material of the elongate reinforcement member 114 and the anchor block 110 material. "Materially compatible" is defined to mean the substantial absence of degradation, oxidation, and/or the absence of any reduction in the mechanical integrity of either the elongate reinforcement member 114 or anchor block 110.

When an adhesive is used, the film thickness can be controlled through a measured tightening of the mechanical fasteners 126, which can reduce the diameter of the axial bore 120 enough to create a uniformly thin film of adhesive around the outer surface of elongate reinforcement member 114, but stop short of actually imposing a mechanical clamping force. The cured adhesive material can have a film thickness from about 0.01 mm (0.00039 in)to about 1.00 mm (0.03937 in) such as about 0.25 mm (0.00984 in). Subsequent to curing, the mechanical fasteners 126 can be optionally further tightened. In another embodiment, the mechanical fastener 126 which is furthest from the tapered opening of bore 120 can be tightened further, to apply an additional clamping force to the elongate reinforcement member 114 in order to impart a mechanical tightening on the elongate reinforcement member 114.

In the exemplary embodiment shown in FIGS. 1A-1C the elongated reinforcement member 114 can have an outer diameter of three-eighths of an inch, while the inner diameter of the axial bore 120 can be thirteen-thirty-seconds of an inch after tapering from a one-half inch opening at the front-end surface 112. Moreover, the elongated reinforcement member 114 can extend an additional quarter-inch out the back and of the axial bore 120, beyond the six inch length of anchor block 110. This is, however, exemplary only and in other embodiments, elongated reinforcement member 114 may extend further or lesser from the back-end surface 118 of anchor block 110. In other embodiments, elongated reinforcement member 114 may not extend out of back-end surface 118, such as where bore 120 extends only partially through anchor block 110.

The end of the elongated reinforcement member 114 can be capped with a button head 144 or other suitable device that can be attached to the elongated reinforcement member 114 with an adhesive or a mechanical press fit. After installation, the button head 144 can serve to prevent the elongated reinforcement member 114 from slipping back through the anchor block 110, and to absorb a portion of the tensile load applied to the elongated reinforcement member 114, as well as provide an aesthetic covering to the exposed ends of elongated reinforcement member 114. Additionally, button heads 144 can provide protection from UV rays, exposure degradation, and intrusion of foreign material into the interface between the anchor block 110 and elongated reinforcement member 114.

The elongated reinforcement member 114 can have a diameter which is greater or less than the exemplary elongated reinforcement member 114 described herein relative to FIGS. 1A-1C, and can thereby allow greater or smaller compressive loads to be applied to the static structure. To compensate, the length of the axial bore 120 of anchor block 110 can be proportional to the rod diameter of elongated reinforcement member 114, such that a thicker elongated reinforcement member 114 is anchored into an anchor block 110 with a longer axial bore 110. This can be done to keep the clamping stresses on elongated reinforcement member 114 constant, regardless of the thickness of elongated reinforcement member 114 or the amount of tensile loading. The proportionality between diameter and length of axial bore 120 may be approximately parabolic.

The anchor block 110 and anchoring device 100 of the example embodiments of the present invention can be materially compatible with the various common materials used in the manufacture and production of industrial elongated reinforcement member 114, including glass fibre reinforced polymer ("GRPF"), aramid fibre reinforced polymer ("AFRP"), carbon fibre reinforced polymer ("CFRP"), and composites or combinations thereof, as well as metallic bars or cables. The above materials can be straight tendons or curvilinear segments. As stated above, "materially compatible" can be defined to mean the substantial absence of degradation, oxidation, and/or the absence of any reduction in the mechanical integrity of either the elongated reinforcement member 114 or anchor block 110. Additionally, each elongated reinforcement member 114 material or combination includes particular material properties which may make it desirable to adjust the design parameters of anchoring system 100, including but not limited to: the length and degree of the axial bore front end taper; the type of taper on the axial bore (e.g., straight or stepped); the length and diameter of the axial bore; the surface area of the front end contact surface; the preferred method of attachment, including direct compression, compression with a deformable sleeve, adhesive attachment, and the like; the number of mechanical fasteners (if any) used; the number and type of washers used; and the number of axial slits; the length of axial slits; the type of axial slits (e.g. stepped, straight, straight tapered, etc); and the like. All of these design parameters can be modified as needed and still allow the anchor block to fall within the scope of the present invention.

Figure 2A:
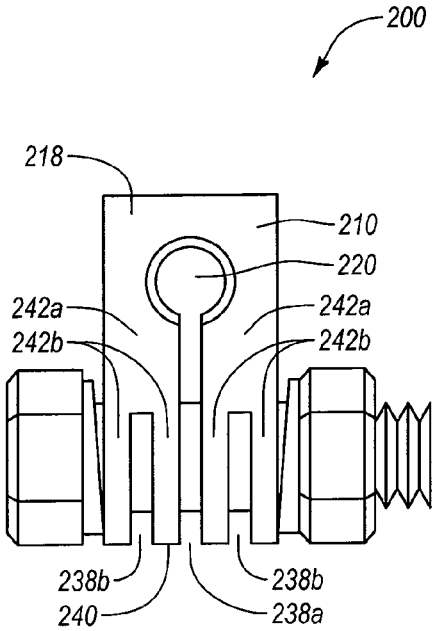
FIG. 2A illustrates a front elevation view of an anchor for an elongated reinforcement member in accordance with another exemplary embodiment of the present invention.
Figure 2B:
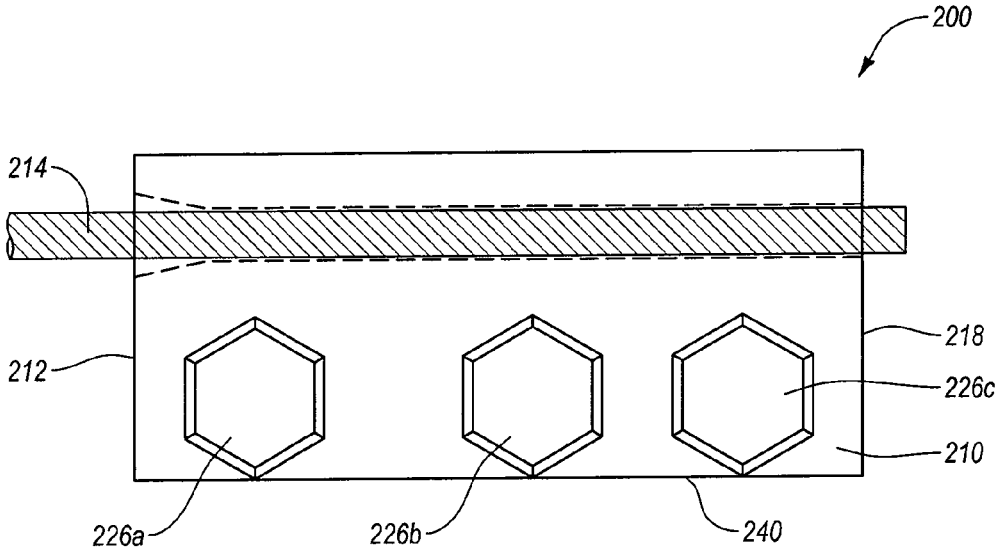
FIG. 2B illustrates a plan view of the anchor illustrated in FIG. 2A.

FIGS. 2A and 2B illustrate another example embodiment of an anchor device 200 within the scope of the present invention, and which can be connected to a free end of an elongated reinforcement member 214. In this embodiment, an anchor block 210 has a construction similar to that of anchor block 110 in FIGS. 1A-1C, but has various different design parameters. For example, back-end surface 218 of anchor block 210 is illustrated in FIG. 2A. In this embodiment, it can be seen that multiple axial slits 238*a*, 238*b* have been formed in anchor block 210. In particular, in this embodiment, a central axial slit 238*a* is formed and extends from bore 220 to side surface 240. In this case, axial slit 238*a* has a substantially straight configuration rather than the stepped, tapered configuration of axial slit 138 in FIG. 1C; however, a stepped configuration may be utilized, as well as another suitable configuration (e.g., straight tapered, parabolic, etc.) and can vary in size such that axial slit 238*a* increases or decreases in size as it extends from bore 220.

Axial slit 238*a* again forms two clamping members 242*a* on either side of axial slit 238*a*. In this case, however, each clamping member 242*a* also includes an additional axial slit 238*b* therein. Axial slit 238*b* thus creates four sub-clamping members 242*b*, such that there are two sub-clamping members 242*b* within each of clamping members 242*a*. It will be noted that the length of axial slits 238*b* in this embodiment is approximately half that of axial slit 238*a*. In other embodiments, however, axial slits 238*b* may have a length equal to or greater than that of axial slit 238*a*, may have a length between one-quarter and three-quarters that of axial slit 238*a*, or may have another suitable length. Moreover, it is not necessary that both axial slits 238*b* have the same configuration or size. For example, one of axial slits 238*b* may be longer, wider, or nearer axial slit 238*a* than the other axial slit 238*b*, and/or axial slits 238 may have different shapes (e.g., different tapered configurations).

Turning now to FIG. 2B, it can be seen that anchor block 210 is configured to receive three mechanical fasteners 226*a*-*c* therein, and which can be used to provide a clamping force on elongated reinforcement member 214. Moreover, in this embodiment, the three mechanical fasteners 226-*c* are distributed unevenly along the axial length of anchor block 210.

More particularly, in this example embodiment, mechanical fastener 226*a* is nearest front-end surface 212 and mechanical fastener 226*c* is nearest back-end surface 218. Intermediate mechanical fastener 226*b* could be positioned to be substantially equidistant from mechanical fasteners 226*a*, 226*b*, but in this embodiment is not so aligned. Instead, mechanical fastener 226*b* is positioned such that it is closer to mechanical fastener 226*c* than to mechanical fastener 226*a*. This may allow, for example, greater clamping force to be placed on the distal end of elongated reinforcement member 214 near back-end surface 218, while allowing for less of a clamping force near front-end surface 212 where failure would be most likely to occur.

Figure 3A:
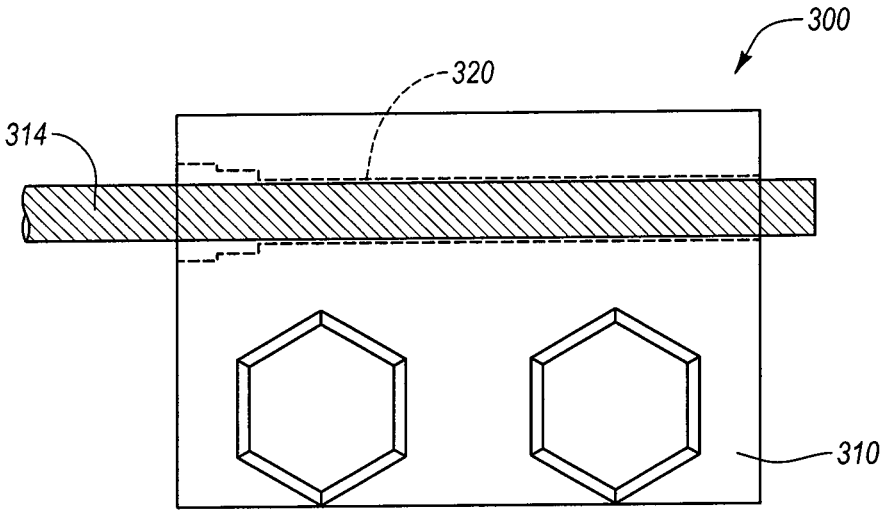
FIG. 3A illustrates a plan view of an anchor for an elongated reinforcement member in accordance with still another exemplary embodiment of the present invention.
Figure 3B:
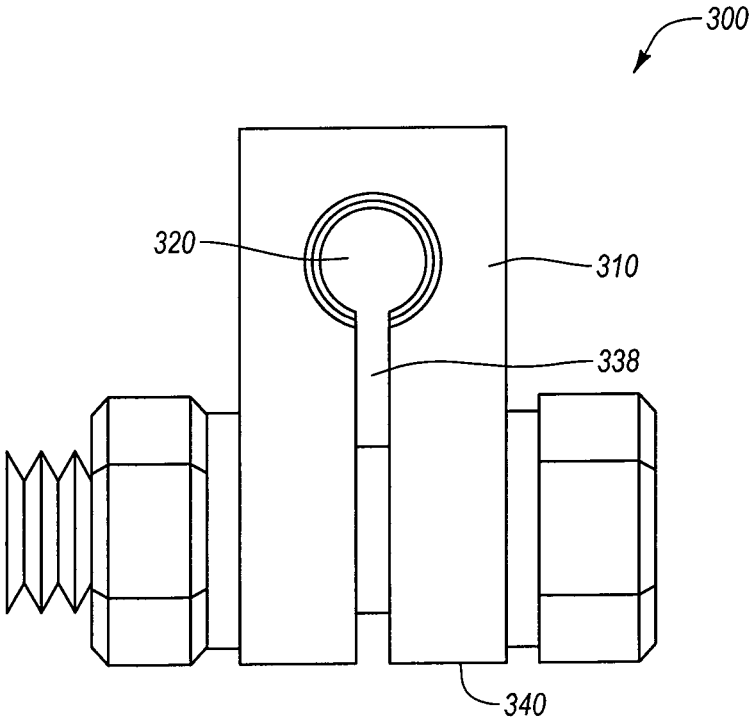
FIG. 3B illustrates a front elevation view of the anchor illustrated in FIG. 3A.

FIGS. 3A and 3B illustrate still another example embodiment of an anchor device 300 within the scope of the present invention, and which can be connected to a free end of an elongated reinforcement member 314. In this embodiment, an anchor block 310 has a construction similar to that of anchor blocks 110 and 210 in FIGS. 1A-2B, but has various additional or different design parameters.

For instance, FIG. 3A illustrates an example design in which two mechanical fasteners 326 are used, instead of three or four, as are used in connection with anchor blocks 210 and 110, respectively. Moreover, in this embodiment, axial bore 320 has a different configuration that uses a stepped-tapered design. The illustrated taper includes two different diameters before reaching the final diameter that extends through most of anchor block 310. Moreover, each of the two steps is approximately the same length. In other embodiments, however, there may be more or fewer steps, and/or the steps may have different lengths. For example, in one example embodiment, a second step has a length that is three times that of a first step.

Turning now to FIG. 3B, it can be seen that anchor block 310 is configured with a single axial slit 338 that extends from axial bore 320 to side surface 340. In this embodiment, axial slit 338 has a substantially straight configuration in which the width of axial slit 338 is substantially constant along its length in the y-direction and in the z-direction. Of course, as will be appreciated by one skilled in the art in view of the disclosure herein, slit 338 may also have other configurations (e.g., FIGS. 1A-1C and FIGS. 2A, 2B).

Figure 3C:
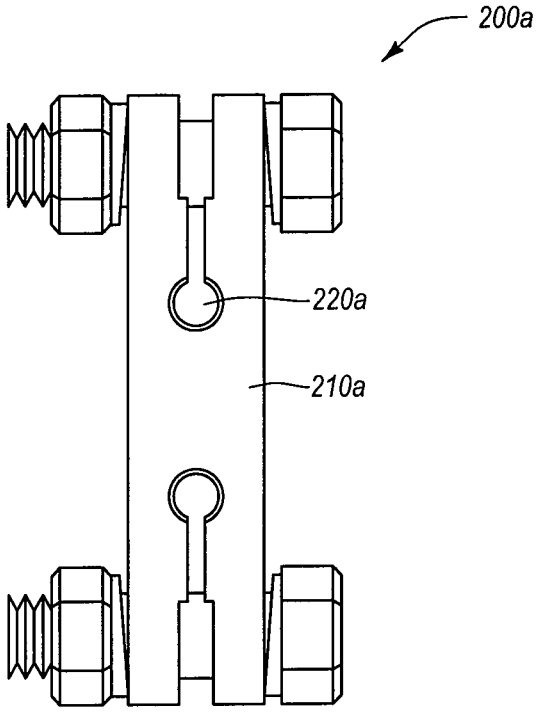
FIG. 3C illustrates an front elevation view of an anchor similar to that in FIG. 3A, in which the anchor has an extended height to be usable for two elongated reinforcement members in accordance with another exemplary embodiment of the present invention.
Figure 3D:
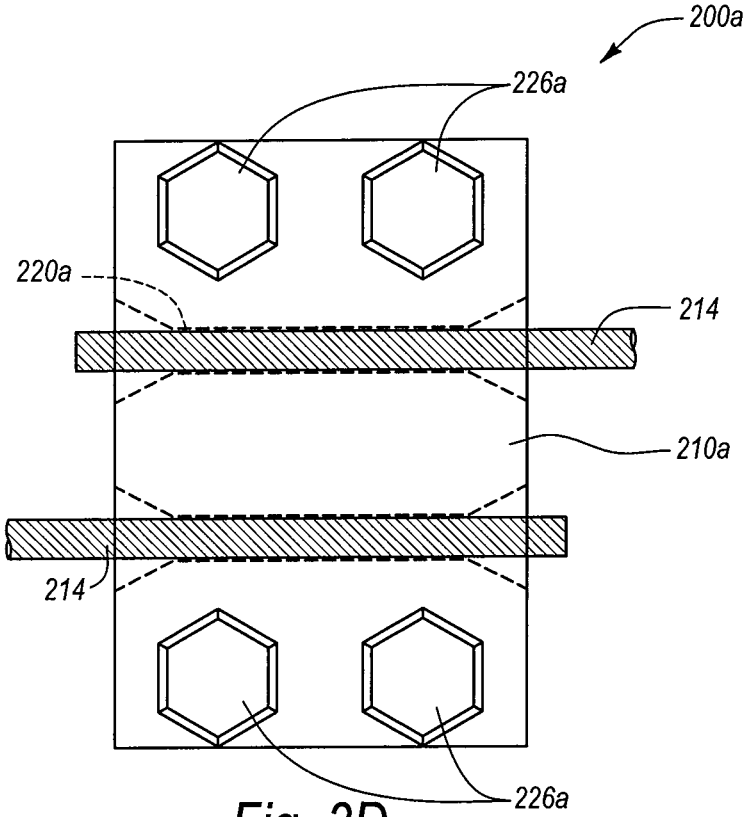
FIG. 3D illustrates a plan view of the anchor illustrated in FIG. 3C.

FIGS. 3C and 3D illustrate another anchor system 200*a* that is an example embodiment of the present invention, and which is similar to that illustrated in FIGS. 3A and 3B, and which can be used with two elongated reinforcement members 214. In this embodiment the anchor block 210*a*, which can be referred to as a double anchor block, can be approximately twice as long in the y-direction as the equivalent single anchor block shown in FIGS. 3A and 3B that are configured for a particular elongated reinforcement member outer diameter.

For simplicity, the illustrated anchor block 210*a* is shown as having four mechanical fasteners 226 (i.e. two for each axial bore 220*a*), although it will be appreciated that any number of mechanical fasteners 226 may be used. For example, there may be eight total mechanical fasteners such that anchor block 210*a* is similar doubling anchor block 110 of FIG. 1C. The double anchor block 210*a* may thus have the appearance of two single anchor blocks joined side-to-side, but can be constructed from a single block of material to provide the mechanical strength and integrity necessary to hold together two elongated reinforcement members 214 under axial loading. In some cases, the two elongated reinforcement members 214 may be free ends of the same reinforcement member. For instance, anchor block 210*a* may be used to secure two ends of the same elongated reinforcement member 214 that is extended around a cylindrical surface such as a tank. Furthermore, the axial bore 220*a* can have tapered openings at both ends as shown in FIG. 3D, although such feature is optional, and the openings may have no tapers, or may have openings on only one end (either the same end or opposing ends).

Figure 4A:
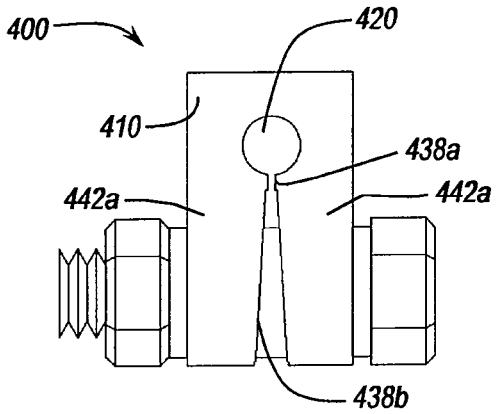
FIG. 4A illustrates a front elevation view of another embodiment of an anchor in accordance with another exemplary embodiment of the present invention.
Figure 4B:
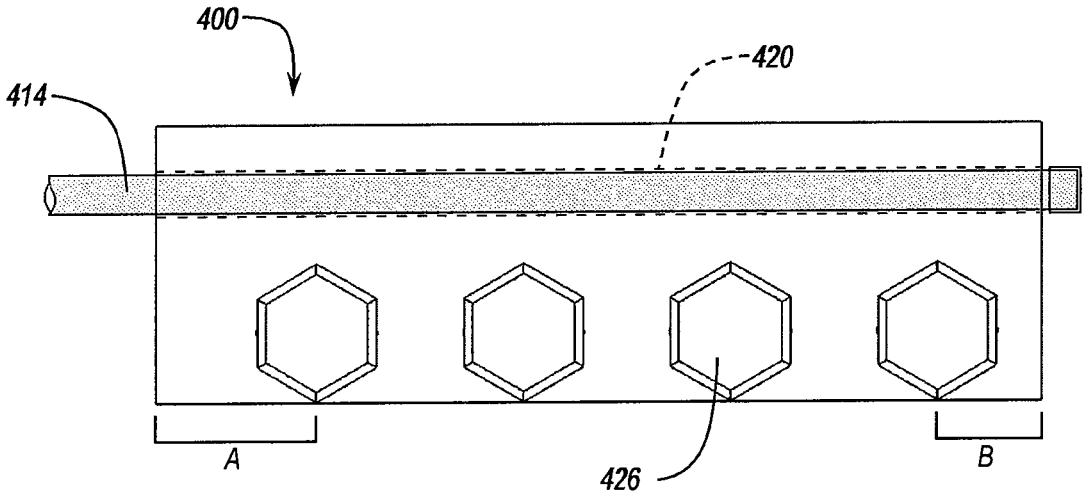
FIG. 4B illustrates a plan view of the anchor illustrated in FIG. 4A.

FIGS. 4A and 4B illustrate still another example embodiment of an anchor system 400 that may be used in connection with one or more elongated reinforcement members 414. As best shown in FIG. 4A, the axial slit in an exemplary device may include a plurality of portions. In this embodiment, for instance, the axial slit includes a neck portion 438*a* and a tapered slice 438*b*. In particular, in the illustrated embodiment, neck portion 438*a* has a width that is less than that of tapered slice 438*b*, and neck portion 438*a* connects bore 420 to tapered slice 438*b*. The proximal end of neck portion 438*a* thus is in communication with bore 420, while the distal end of neck portion 438*a* is in communication with tapered slice 438*b*.

In this embodiment, tapered slice 438*b* extends from the distal end of neck portion 438*a* to the bottom-side surface of anchor block 410. In this manner, neck portion 438*a* and tapered slice 438*b* collectively define two halves that act as clamp members 442*a*. In particular, as the fasteners 426 are tightened, claim members 442*a* draw together, thereby at least partially closing tapered slice 438*b* and neck portion 438*a*. This further causes bore 420 to contract and compress an elongated reinforcement member 414 that is disposed within bore 420.

In one aspect, it may be desirable to have a reduced width of neck portion 438*a*. For example, elongated reinforcement member 414 may be an FRP rod. In such a case, as bore 420 contracts, outside fibres on the rod may be pressed against neck portion 438*a*. With a reduced size of neck portion 438*a*, fewer fibers—and possibly no fibres—may be pressed within neck portion 438*a*. This may result in fewer fibres being broken.

As will be appreciated by one skilled in the art in view of the disclosure herein, there are various reasons why breaking any of the fibres within elongated reinforcement member 414 can be detrimental. For example, bore 420 may be sized for a particular diameter of an elongated reinforcement member 414. As fibres on the rod are broken, or as the surface of any type of elongated reinforcement member are worn down, the diameter of the reinforcement member decreases. This can thus created extra space within anchor block 410 that results in a loosened clamp of reinforcement member 414.

Additionally, in a FRP rod, each fibre contributes to the maximum load that can be carried by the rod. As fibres are broken, the overall load carrying ability of the FRP rod is reduced. This can then cause the elongated reinforcement member 420 to fail earlier than a similar rod with its fibres preserved.

It will be noted that one feature of the anchor designs presented herein is the ability to clamp around the surface of an elongated reinforcement member while reducing stress concentrations that can cause failure of fibres or other portions of the clamped reinforcement member. For example, wedge-type claims and clamshell clamps are common with steel rod applications where the material is substantially uniform throughout. Notably, however, when those clamps are used with a FRP rod or other fibre-rod that has multiple fibres rather than a uniform material, the clamping at a particular location causes localized stresses. For example, an elongated reinforcement member may be placed in tension with a force of 1 T. If the rod is grasped and fibers are displaced at an example angle of forty-five degrees, the tension at the location of displacement is no longer 1 T, but is approximately 1.414 T. As a result, the displaced fibres can fail forty-percent sooner than fibres in a rod without such displacement. Of course, fibres that are pinched or engaged against other sharp surfaces may have even greater stress concentrations and can fail even earlier.

An anchor device 400 according to the present invention can make use of multiple features to minimize such localized stresses. For example, anchor device 400 includes multiple fasteners 426 that are used to clamp the two clamping members 442 together, and to draw bore 420 around elongated reinforcement member 414. By exerting a clamping pressure with more fasteners, the clamping pressure can be more evenly distributed to reduce localized stresses. Additionally, and as best shown in FIG. 4B, the front-end of anchor block 410 may also be configured to reduce stress at the leading edge where localized stresses are most problematic.

In particular, the illustrated embodiment shows a distance A between the front-end surface of anchor block 410 and the first fastener 426. Additionally, a distance B is shown between the back-end surface of anchor block 410 and the last fastener 426. In some embodiments, the distances A and B can be varied to obtain desired results. For example, in the illustrated embodiment, distance A is greater than distance B. As a result, if all of fasteners 426 are tightened the same amount, the opening of the axial slit at the back end of anchor block 410 would likely be reduced more than the opening of the axial slit at the front end of anchor block 410.

In some embodiments, the distance B may be the about half the distance between fasteners 426. It will be appreciated that this can thus cause a tapering effect where bore 420 and/or the axial slit decrease in size from the front-end to the back end. Thus, it is not necessary for all embodiments to include a taper at the front end surface. Instead, an equivalent effect may be obtained by merely placing fasteners a greater distance from the front end of anchor block 410 than the distance from the back end of anchor block 410 and/or a distance greater than half the distance between center lines of fasteners 426. Further, as discussed herein, it may also be possible to obtain a similar effect by tightening the first fastener 426 less than the remaining fasteners 426. This may also be avoided, however, by setting the distance of the first fastener 426 from the front-end of anchor block 410.

The particular dimensions of anchor block 410 can be varied according to a variety of factors and design parameters. Accordingly, no single size or dimension, or even relationship between dimensions, is limiting of the present invention. In one example, however, anchor block 410 may have a length of approximately six-and-one-half inches, a height of two-and-one-quarter inches, and a width of one-and-one-half inches. Along the axial length of anchor block 410, there may be four fasteners 426. In one example, a first fastener is positioned three-quarters of an inch from the front end of anchor block 410, while the fourth fastener is positioned one-and-one-quarter inch from the back end. Each of the fasteners may then be offset one-and-one-half inches from the adjacent fasteners (measured center-to-center). In such an embodiment, it can thus be seen that the distance from the front end of anchor block 410 to the center of the nearest fastener 426 is larger than the distance from the faster 426 nearest the back-end surface of block 410. Further, the distance from the front end of anchor block 410 to the center of the nearest fastener 426 (e.g., on-and-one-quarter inch) can be greater than half the distance between adjacent fasteners as measured center-to-center (e.g., three-quarters inch).

In such a configuration, axial bore 420 may be set for an elongated reinforcement member of a particular size. For example, in the described example, the diameter of axial bore 420 may be three-eighths of an inch. Neck portion 438*a* may then have a length of one-eighth inch, and tapered portion 438*b* can extend a distance of approximately one inch and taper at an angle of five degrees. Of course, these dimensions are merely exemplary and non-limiting, and can be varied considerably for any desired application.

Figure 4C:
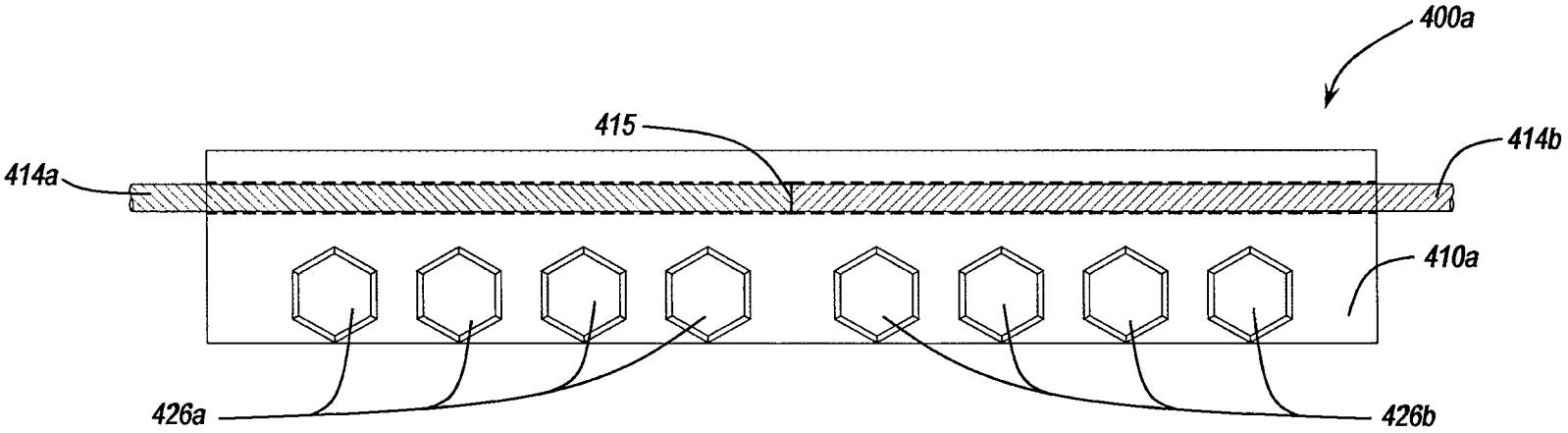
FIG. 4C illustrates a plan view of an anchor similar to that in FIG. 4A, in which the anchor has been extended axially to facilitate splicing two elongated reinforcement members together.

Turning now to FIG. 4C, an example embodiment of an anchor 400*a* is illustrated and that has been modified from anchor block 410 of FIGS. 4A and 4B. Such may be useful, for example, as a splicing device. In particular, in the illustrated embodiment, anchor block 410*a* has an axial length that is approximately twice that of anchor block 410 in FIG. 4B. In such a case, the z-distance of the splicing anchor has thus been increased (e.g., approximately doubled) to provide a suitable contact pressure for maintaining the elongated reinforcement members 414*a*, 414*b* securely within the anchor 400*a*. In addition, there are eight fasteners 426*a* attached to anchor block 410*a*, although the number of fasteners 426*a* used can be varied.

In such an embodiment, a free ends of each of two elongated reinforcement members 414*a*, 414*b* can be inserted into the openings of the bore at each end of anchor block 410*a*. The elongated reinforcement members 414*a*, 414*b* can each be inserted to approximately the mid point of anchor bloc, 410*a*, until the butt ends of elongated reinforcement members 414*a*, 414*b* contact each other to form a butt tight joint 415. Mechanical fasteners 426*a* can then be tightened to close the gap in the axial bore and create a clamping force prior to tensioning of the elongated reinforcement members 414*a*, 414*b*. Various pressures can be applied using mechanical fasteners 426*a*, so that the gap created in the axial slit can be closed as much as compressive forces on the elongated reinforcement members 414*a*, 414*b* will allow, while also bending and yielding the clamp members formed by the axial slit.

Figure 5:
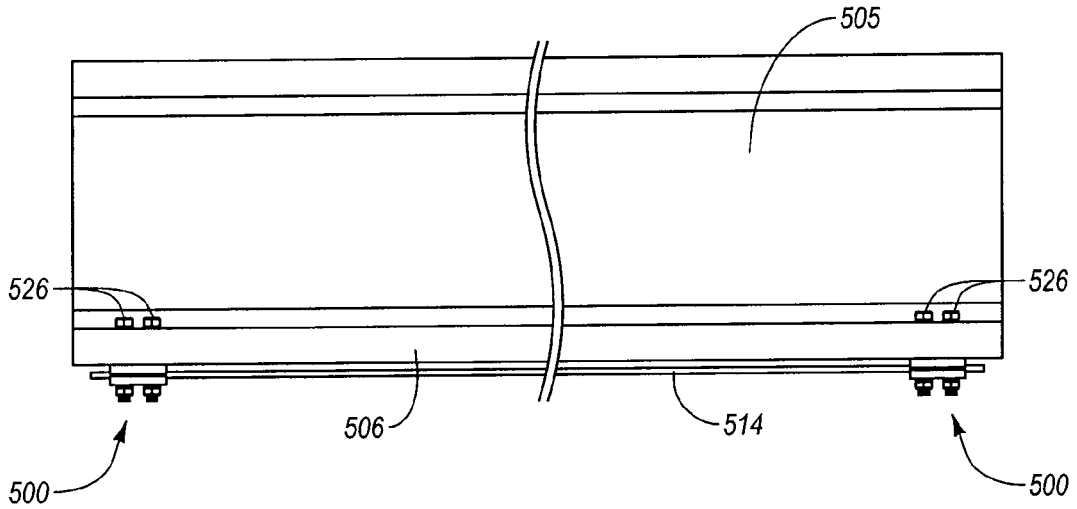
FIG. 5 illustrates a side view of a beam that is reinforced with one or more elongated reinforcement members using an anchoring system.
Figure 6A:
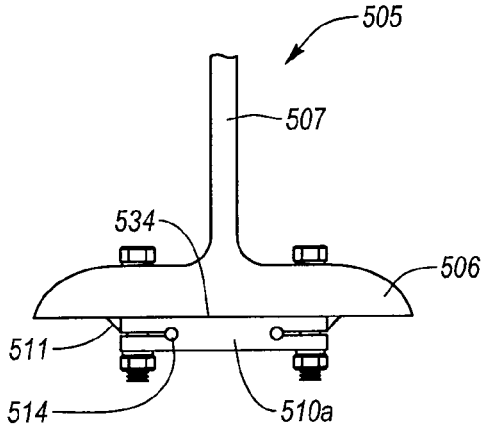
FIG. 6A illustrates a partial, front elevation view of a beam that is reinforced using an anchor and two elongated reinforcement members.
Figure 6B:
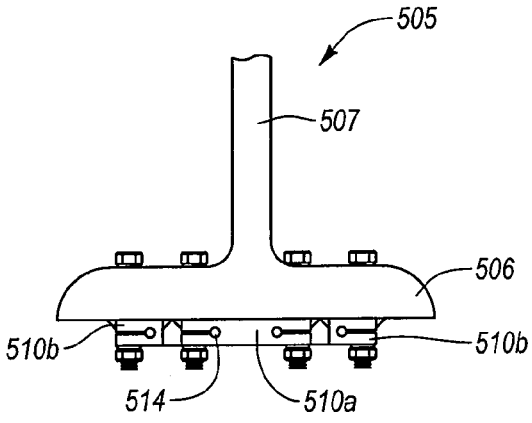
FIG. 6B illustrates a partial, front elevation view of an I-Beam that is reinforced using three anchors and four elongated reinforcement members.

FIGS. 5-6B are illustrative of example embodiments illustrating the use of anchors as described herein in reinforcing a static structure. In FIG. 5, for example, a beam 505 (e.g., an I-Beam) has one or more elongated reinforcement members 514 attached thereto by way of anchoring systems 500. In particular, one anchoring system 500 is attached to beam 505 near each opposing axial end. An elongated reinforcement member 514 is then secured at each anchoring system 500 and provides reinforcement for beam 500 to prevent failure due to flexural and/or shear stresses. Additionally, while anchor systems 500 are illustrated as including only two mechanical fasteners 526, this is for simplicity only and more or fewer mechanical fasteners may be used as suits the particular application.

FIGS. 6A and 6B illustrate various specific mechanisms that allow elongated reinforcement member(s) 514 to be attached to beam 500 and to provide reinforcement thereto. In FIG. 6A, for example, two elongated reinforcement members 514 are used to reinforce beam 505. In this embodiment, a clamp side surface 534 of anchor block 510*a* is placed such that it contacts the bottom surface of flange 506 of beam 505. Anchor block 510*a* may be secured thereto by any suitable means. For example, in one embodiment, beam 505 may be a steel beam such that welds 511 (e.g., fillet welds) may be used to secure anchor block 510 thereto. Even where a steel beam is used, however, welds 511 are optional.

In other embodiments, however, it isn't necessary that anchor block 510*a* be welded to beam 505. Indeed, in the illustrated embodiment, mechanical fasteners 526 may be used instead of welds 511, or they may be used in conjunction therewith. In particular, mechanical fasteners 526 are, in this embodiment, configured to secure anchor block 510 to flange 506 by extending through flange 506 and anchor block 510. In this case, beam 505 may have holes (not shown) that generally align with the holes in anchor block 510 that are used for mechanical fasteners 526. As a result, when anchor block 510 is placed against beam 505, the holes in each may be aligned, and mechanical fasteners may be passed through both flange 506 and anchor block 510.

For instance, a mechanical fastener 526 may include a bolt that is first inserted through flange 506 and then passes through anchor block 510. A corresponding nut may be attached to the clamping bolt and then tightened to secure anchor block 510 to flange 506. Mechanical fasteners 526 may also include washers (e.g., tapered washers) on one or both ends of mechanical fasteners 526 to distribute the forces applied thereto circumferentially around the washer.

In the embodiment illustrated in FIG. 6A, anchor block 510*a* may be a double anchor block 510 similar to that in FIGS. 4A and 4B, except that both elongated reinforcement members 514 enter into the same front-end surface of anchor block 510. In such a case, double anchor block 510 may be approximately centered around post 507 connecting two flanges 506. There may thus be corresponding holes on each side of post 507 and the two elongated reinforcement members 514 can also be placed on the bottom of flanges 506 and such that they too are on either side of post 507.

FIG. 6B illustrates another example embodiment in which four elongated reinforcement members 514 are used to reinforce beam 505. In this embodiment, a double anchor block 510*a* similar to that in FIG. 6A is also attached to beam 505 such that it is approximately centered relative to post 507. Extending outward anchor block 510*a* are additional single anchor blocks 510*b* that are attached to flanges 506 in a similar manner, by extending mechanical fasteners 526 through flanges 506 and anchor blocks 510*b*. Anchor blocks 510*b* may also be attached by welds 511 for additional support.

In the particular example illustrated in FIG. 6B, all four elongated reinforcement members 514 are located on the bottom of flange 606. It will be appreciated in view of the disclosure herein, however, that this is not necessary. For example, single anchor blocks 510*b* could also be placed on the upper surface of flange 506, thereby allowing reinforcement on the top surface of flange 506. In this manner, reinforcement of beam 505 may be on a top surface, bottom surface, or a combination of both surfaces.

Figure 7:
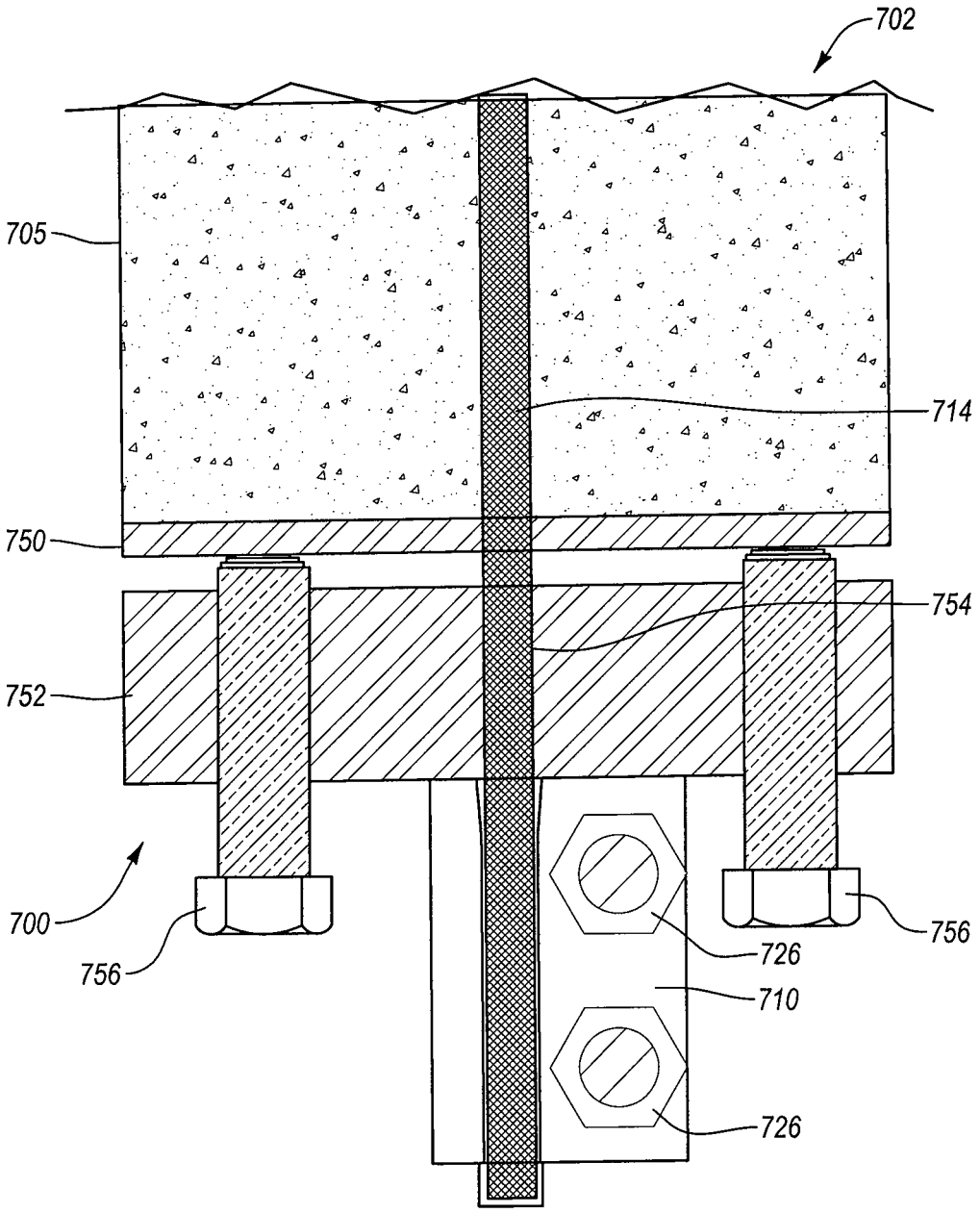
FIG. 7 illustrates a post-tensioning device for reinforcing a static structure with an elongated reinforcement member.

FIG. 7 is illustrative of another exemplary embodiment of the present invention in which a post-tensioning, or self-tensioning, device 700 can be interposed between the anchor block 710 and the contact surface of the static structure 702, which in this example is a plate 750 covering a beam 705. The tensioning device 700 can include, in this example embodiment, a solid plate 752 having a tendon hole or slot 754 with a diameter at least as large as the diameter of elongated reinforcement member 714. Optionally, the tendon hole or slot 754 has a diameter smaller than the diameter of the opening at the front end of anchor block 710. Tensioning device 700 can also include a means for creating a gap between pre-stressing device 700 and the contact surface of static structure 702. In this example embodiment, such means for creating a gap includes a plurality of tensioning bolts 756, two of which are shown in the drawing. Other means for creating and supporting the gap can be appreciated by one of skill in the art, including hydraulic jacks, shims, spacer bars, and the like.

In the embodiment shown in FIG. 7, tensioning device 700 can be installed first over a free end of elongated reinforcement member 714 extending from static structure 702, followed by anchor block 710. Optionally, mechanical fasteners 726 (e.g., clamping bolts) can be tightened, and/or an adhesive can be applied, to bond or clamp anchor block 710 to the free end of elongated reinforcement member 714. Elongated reinforcement member 714 can also be cut to length, if desired, and a button head may also be attached to the stub ending of elongated reinforcement member 714. If an adhesive is used to bond anchor block 710 to elongated reinforcement member 714, a sufficient period of time may be allowed to pass to allow the adhesive to cure. Once the bond or clamping force between anchor block 710 and free end of elongated reinforcement member 714 is fully formed, tensioning bolts 756 in pre-stressing device 700 can be activated to create or enlarge the gap between the pre-stressing device 700 and the contact surface of static structure 702 (in this case the surface of steel plate 750). Forming or enlarging the gap stretches elongated reinforcement member 714 into tension, resulting in an equal and opposite compression reaction force that passes from anchor block 710 to pre-stressing device plate 752, to tensioning bolts 756, to steel contact surface 750, and ultimately into beam 702. A similar pre-stressing device 700 may be attached at an opposing end of static structure 702 to provide another attachment mechanism, and both ends can utilize tensioning bolts 756 or another means for creating a gap between pre-stressing device 700 and the contact surface of static structure 702.

As will be appreciated by one skilled in the art in view of the disclosure herein, anchor block 710 may be secured to static structure 702 even in the absence of plate 750 and bolts 756. For example, in one embodiment, anchor block 710 may directly engage the contact surface of plate 750 on static structure 702, or it may directly engage beam 705. A similar anchor block 710 may then be secured at an opposite end of static structure 702 (either alone or using a pre-tensioning system). Tensile forces within elongated reinforcement member 714 may then hold anchor block 710 into engagement with static structure 702. In some embodiments, anchor block 710 may also be secured directly to plate 750 in other manner (e.g., welding). Additionally, while the illustrated embodiment shows reinforcement member 714 passing through beam 705, this is merely exemplary. In some embodiments, reinforcement member 714 may pass adjacent to, along, or otherwise on the exterior of beam 705. In still other embodiments reinforcement member 714 may pass through beam 705, but may be fully or partially contained within a sleeve or used with a debonding agent.

Figure 8:
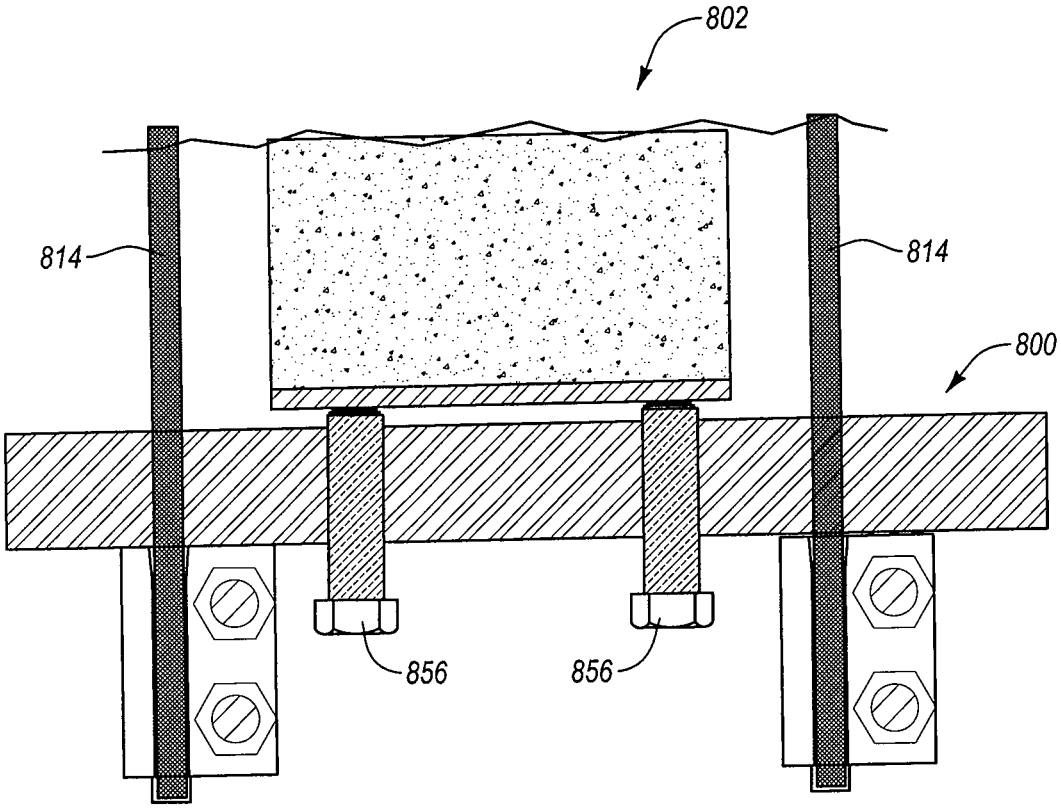
FIG. 8 illustrates another example embodiment of a post-tensioning device for reinforcing a static structure, and uses multiple elongated reinforcement members.

FIG. 8 illustrates a similar configuration of a pre-stressing device 800. In FIG. 8, however, multiple elongated reinforcement members 814 run along an outside surface of the static structure 802, there are multiple tensioning bolts 856, and pre-stressing device 800 is supported between the two elongated reinforcement members 814.

It can be appreciated by one of skill in the art in view of the disclosure herein that various types of elongated reinforcement members can be very strong when placed into tension, but can be susceptible to wear and fatigue if subjected to significant lateral or shear stresses. To alleviate problems associated with transverse shear stresses, the pre-stressing device 700 in FIG. 7 and the pre-stressing device 800 in FIG. 8 can be employed in a manner that balances the forces and moments applied to the elongated reinforcement members. For instance, the front and back surfaces of the pre-stressing devices can be parallel with each other and perpendicular to the tension bolts, and the tensioning bolts can be activated in a uniform manner to keep the pre-stressing device parallel with the contact surface of the static structure to ensure that twisting and bending forces are minimized. Furthermore, the tendon hole or slot in the pre-stressing device can be made large enough to accommodate lateral misalignment between the anchor block and pre-stressing device with the static structure.

As will also be appreciated in view of the disclosure herein, the post-tensioning device illustrated in FIG. 8 may have other uses. For example, a similar configuration could be used in a fixed bed for pre-tensioning applications.

Figure 9A:
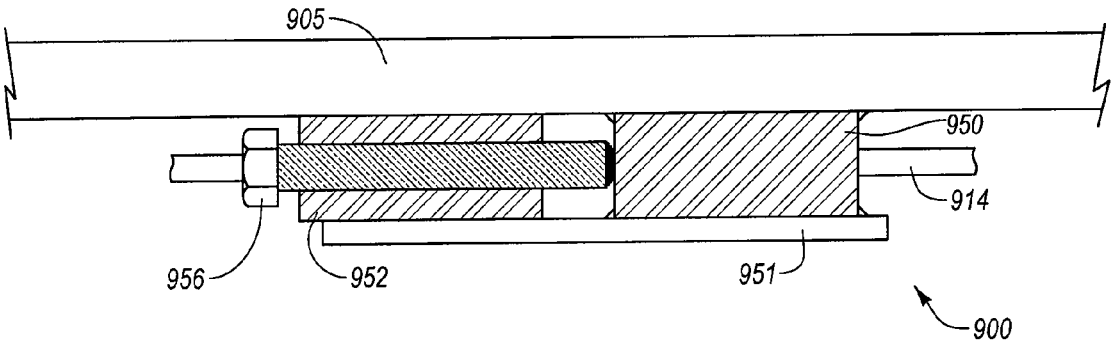
FIG. 9A illustrates another example of a pre-stressing device for reinforcing a static structure.
Figure 9B:
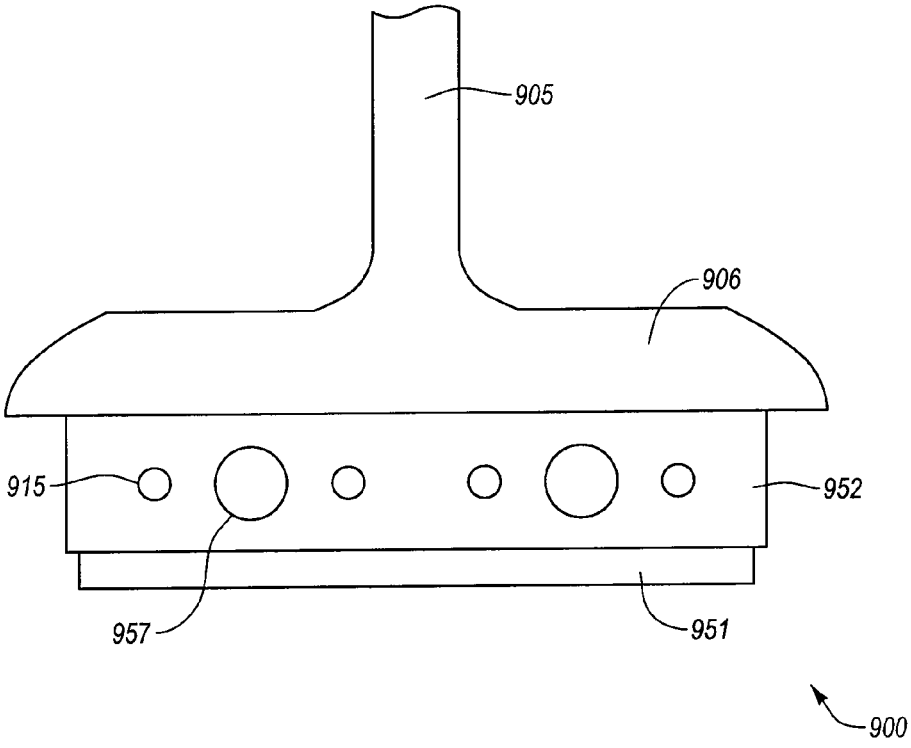
FIG. 9B illustrates a side view of the pre-stressing device of FIG. 9A.

Turning now to FIGS. 9A and 9B, another example embodiment of a tensioning and pre-stressing device is illustrated. In particular, a pre-stressing device 900 is illustrated that can be connected to a beam 905 or to some other static structure. In this embodiment, a bottom contact surface is provided on the beam 906 and a reaction block 950 is secured thereto. Reaction block 950 may be secured in a suitable manner. For instance, in the illustrated embodiment, reaction block 950 is shown to be welded to beam 905; however, other fastening mechanisms may be used.

Also used in connection with reaction block 950 is a stressing head plate 952 through which one or more stressing bolts 956 and elongated reinforcement members 914 pass. Unlike reaction plate 950, stressing head plate 952 is permitted to move relative to beam 905. Such motion may be constrained in one or more directions, however, by elongated reinforcement members 914 and/or a guide plate 951. In particular, a guide plate 951 may be welded or otherwise secured to reaction block 950, and extend towards stressing head plate 952 so as to provide a guide along which stressing head plate 952 can move. Elongated reinforcement members 914 can optionally pass through reinforcement head plate 952 and/or reaction block 950, thereby also providing a guide for movement of stressing head plate 952.

Head plate 952 is moved by the tightening and loosening of stressing bolt 956. In particular, as stressing bolt 956 is tightened, stressing bolt 956 may push stressing head plate 952 away from reaction block 952. An anchor (not shown) may be attached to elongated reinforcement member 914 and, as stressing head plate 952 moves away from reaction block 952, it may cause a tensile force to be exerted on elongated reinforcement member 914. In turn, this causes the anchor to exert a compressive force on stressing head plate, and ultimately places a compressive force on beam 905. Once a desired tension has been obtained, the void between reaction block 950 and stressing head plate 952 may be filled with a shim or other member. For example, a steel shim may be placed between head plate 952 and reaction block 950 and be sized such that it fits the space left therebetween.

As shown in FIG. 9B, stressing head plate 952 may allow for multiple stressing bolts 956 and/or multiple elongate reinforcement members 914 to be used in connection with reinforcing beam 906. In particular, head plate 952 may be placed along the underside of flange 906 of beam 905. In this embodiment, there are four openings 915 configured to receive elongated reinforcement members 914, and two openings 957 configured to receive stressing bolts 596. An anchor may thus be attached to an elongated reinforcement member 914, and the member can then be extended through one of openings 914. To facilitate tensioning with stressing bolts 956, stressing head plate 952 may have internal threads cut or otherwise around holes 957 to mate with the threads of stressing bolt 956, thereby allowing stressing head plate 952 to move relative to reaction block 950.

Figure 10:
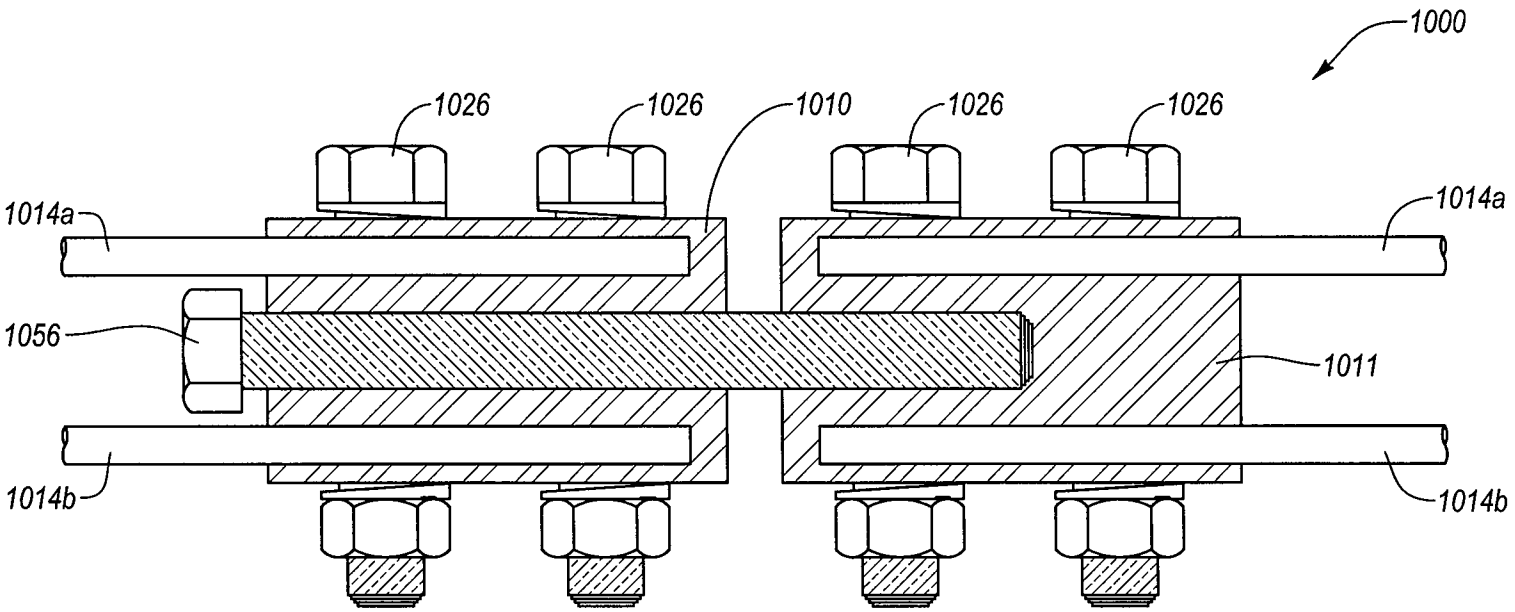
FIG. 10 illustrates a pre-stressing device for reinforcing a static structure in which elongated reinforcement members extend circumferentially around the static structure and where a stressing bolt is placed in tension.

Turning now to FIG. 10, another exemplary pre-stressing device 1000 is illustrated. It will be appreciated that this device 1000 is merely representative of suitable pre-stressing devices, and is therefore exemplary and not limiting in scope. Pre-stressing device 1000 is configured to allow elongated reinforcement members 1014*a*, 1014*b* to be extended along or around a static object, while providing tensioning and reinforcement thereof. For example, pre-stressing device 1000 may be used, in one example application, for elongated reinforcement members 1014*a*, 1014*b* that run circumferentially around a static structure such as a tank.

In particular, the illustrated embodiments show two anchor blocks 1010, 1011 that are arranged in parallel fashion. The first anchor block 1010 has a stressing bolt 1056 passing therethrough. In one embodiment, anchor block 1010 includes an axial opening through which stressing bolt 1056 passes. Stressing bolt 1056 may then optionally pass fully through anchor block 1010 and then enter anchor block 1011. Anchor block 1011 may also have an axial opening to receive stressing bolt 1056. Optionally, anchor block 1011 has an internal thread profile that can receive stressing bolt 1056 and allow engagement therewith.

As will be appreciated, as a person tightens stressing bolt 1056, anchor block 1010 may be drawn towards anchor block 1011. Anchor blocks 1010 and 1011 may also be adapted to receive elongated reinforcement members 1014*a*, 1014*b*. For example, anchor blocks 1010 and 1011 may be configured similar to anchor block 410 of FIG. 4B. In particular, an opening may be formed in anchor blocks 1010, 1011 and adapted to receive elongated reinforcement members 1014*a*, 1014*b*. Various fasteners 1026 may be used to exert a clamping force to cause elongated reinforcement members to be secured within anchor blocks 1010 and 1011.

As can be seen in the illustrated embodiment, it is not necessary that the opening in anchor blocks 1010, 1011 pass all the way therethrough. In this embodiment, the opening passes only partially through anchor blocks 1010, 1011. In operation, a user can insert elongated reinforcement member 1014*a* into anchor block 1010. Such elongated reinforcement member 1014*a* may be extended circumferentially around a static structure, and then inserted into anchor block 1011. A similar process can be repeated for elongated reinforcement member 1014*b*. Fasteners 1026 may then be fastened to provide the same or different clamping forces. As stressing bolt 1056 is then turned, anchor block 1010 and anchor block 1011 can draw closer, thereby placing a tensile force on elongated reinforcement members 1014*a*, 1014*b*.

Figure 11A:
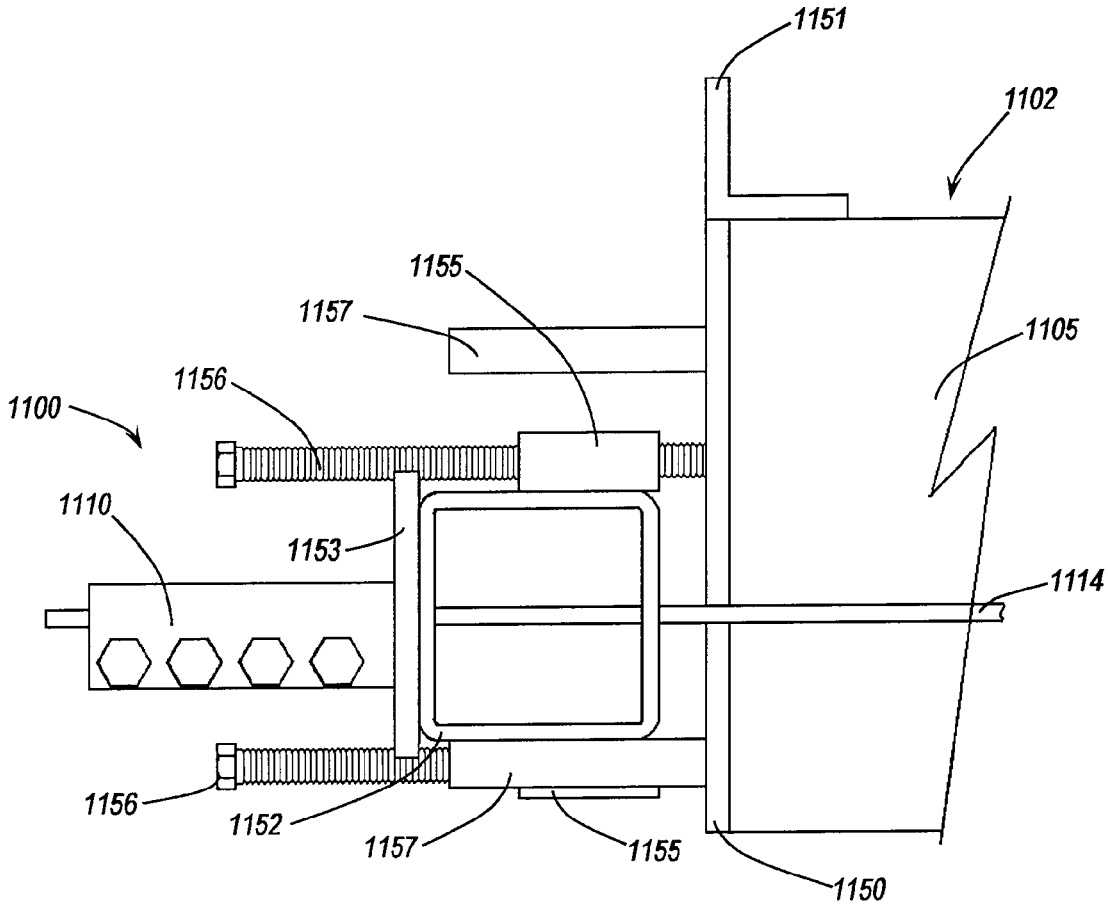
FIG. 11A is a side view of a post-tensioning device for reinforcing a static structure with one or more elongated reinforcement members.
Figure 11B:
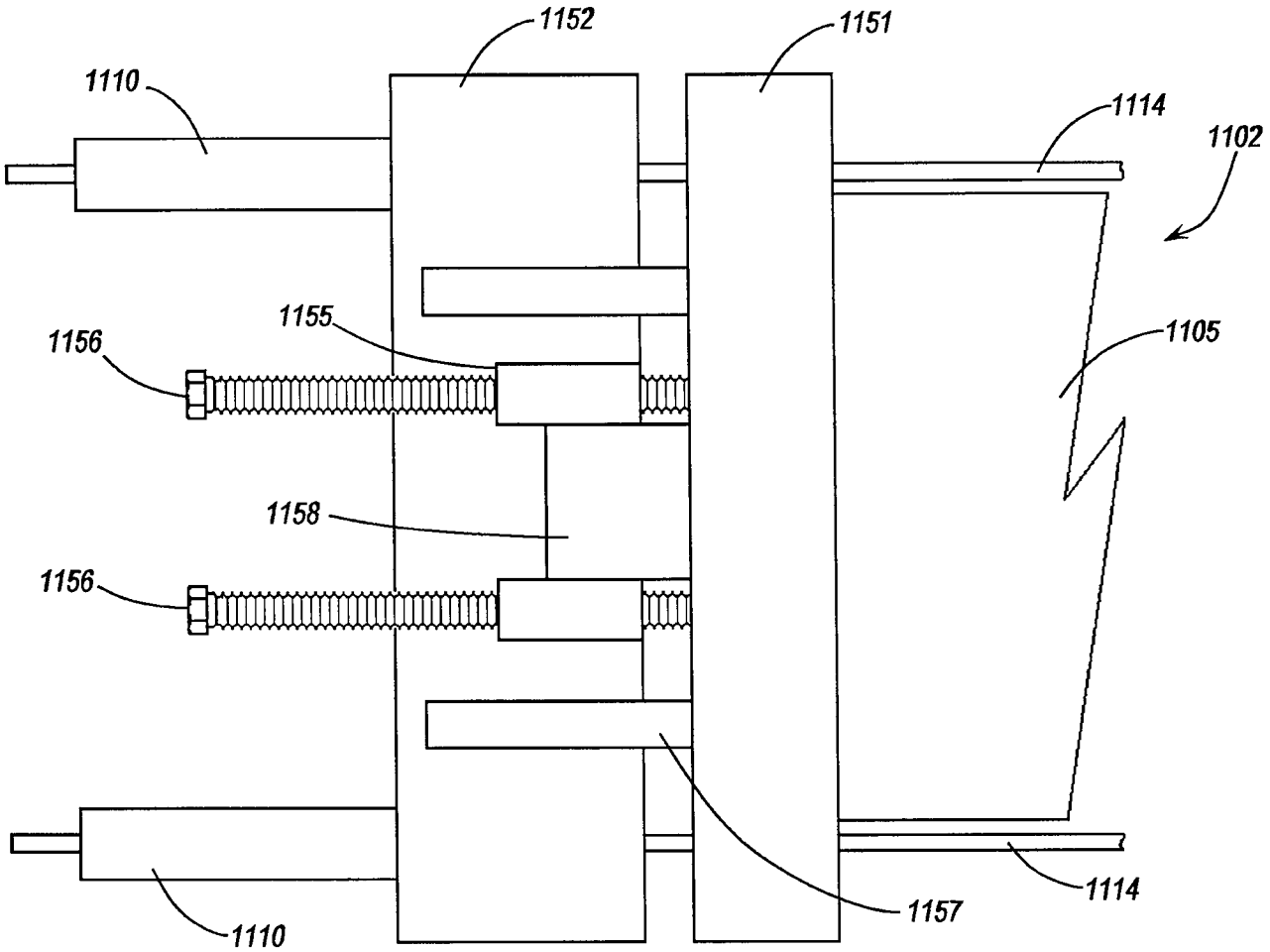
FIG. 11B is a top view of a post-tensioning device similar to that in FIG. 11A.

FIGS. 11A and 11B illustrate additional post-tensioning devices 1100 according to other exemplary embodiments of the present invention. For example, with reference to FIG. 11A, a post-tensioning device 1100 is illustrated and includes an anchor 1110 that connects to a reinforcement member 1114 that runs along the side of, and reinforces, beam 1105. In this embodiment, there is also a tensioning system that allows for a tension to be applied to elongated reinforcement member.

More particularly, structure 1102 includes a beam 1105 to which a plate 1150 is mounted. Plate 1150 can be mounted in any suitable manner, and may be permanently or temporarily affixed to beam 1105. In this embodiment, plate 1150 is mounted on beam 1105 using an elbow 1151. More particularly, elbow 1151 is connected to plate 1150. Elbow 1151 includes a flat bottom surface which can be placed and rest on a top surface of beam 1105. This could be an example of a temporary connection of plate 1150 to beam 1105. Plate 1150 could also be welded to beam 1105 if beam 1105 were made of steel or another material allowing a welded connection.

In this embodiment, there are also four supports 1157 that extend from plate 1150. In particular, in this example there are two top supports (shown as a single support in the side view of FIG. 11A) and two bottom supports (also shown as a single support in the side view of FIG. 11A). Supports 1157 can also be connected to plate 1150 in any suitable manner. For instance, plate 1150 and supports 1157 may be made of steel and can be welded together.

Tensioning system 1100 can also include a tube 1152. In some embodiments, tube 1152 can provide a function similar to that of solid plate 752 of FIG. 7. Of course, tube 1152 may be hollow, but tube 1152 could also be replaced by a solid mass. In this embodiment, tube 1152 is positioned on the lower set of supports 1157. In this embodiment, tube 1152 also has four nuts 1155 mounted thereon (two on a top surface and two on a bottom surface). Nuts 1155 are configured to engage with corresponding stressing bolts 1156.

Before tensioning occurs, tube 1152 may be positioned in contact with plate 1150. As tensioning occurs, stressing bolts 1156 can be tightened. As bolts 1156 are tightened, they can engage against plate 1150. As a result, tightening of bolts 1156 can cause tube 1152 to separate from plate 1150. In the illustrated embodiment, supports 1157 may provide a guide as tube 1152 moves outward or inward relative to plate 1150. Additionally, an anchor block 1110 that has a front-end or other surface abutting tube 1153 may also move as tube 1152 moves relative to plate 1150 and beam 1105. In particular, as tube 1152 moves away from plate 1150, anchor block 1110 also moves away from plate 1150. When elongated reinforcement member 1114 is positioned within anchor, this can thus cause an axial tension to be placed on elongated reinforcement member 1114.

In some embodiments, anchor block 1110 may not directly engage tube 1152, but may instead indirectly connect to tube 1152 through one or more intermediate components. In FIG. 11A, for example, a distribution plate 1153 is positioned between anchor block 1110 and tube 1152. Although distribution plate 1153 is optional, it may be desired for some applications. For example, when tube 1152 is hollow, sufficient axial tension may be applied through tightening stressing bolts 1156 that the compressive load transferred to tube 1152 such that tube 1152 begins to collapse. Such effect may be particularly likely if a hole or slot is formed in tube 1152 to allow elongated reinforcement member 1114 to pass therethrough. To reduce the likelihood of such a collapse, distribution plate 1153 can be used. As anchor 1152 presses against distribution plate 1153, the forces that would normally be localized on the front end of anchor block 110 can be transferred throughout the larger surface area of distribution plate 1153, thereby reducing the likelihood of failure of tube 1152.

Plate 1150 can provide a similar function. For example, beam 1105 may be made of timber, concrete, masonry, and the like. A device similar to tensioning device 1000 may be used without plate 1150, such that stressing bolts 1156 directly engage beam 1105. With materials such as timber, concrete and masonry, the force transferred by bolt 1156 may be distributed about only the surface area of the leading end of the bolt. This can cause beam 1105 to deform, break, or even fracture. By engaging bolt 1156 against plate 1150, however, the forces of stressing bolts 1156 can be distributed over a larger surface area and avoid localized damage.

As noted previously, tube 1152 may have a hole therein through which elongated reinforcement member 1114 can pass as it is placed along the side or other surface of beam 1105. Elongated reinforcement member 1114 can thus be placed along beam and within the hole prior to attachment of anchor block 1110 to the reinforcement member 1114. Alternatively, however, tube 1152 may have a slot formed therein. The slot can extend to an outer surface. This would allow, for example, anchor 1110 to be attached to elongated reinforcement member 1114 before elongated reinforcement member placed along beam and/or placed within tensioning device 1110.

As also noted above, more than one support 1157 may be attached to plate 1150. In this embodiment, a bottom set of supports 1157 supports tube 1152 and guides it as it moves. Such supports 1157 may be separate (as shown in FIG. 11B), or may be a single plate acting as a support and/or guide. As also shown in the illustrated embodiment, upper supports 1157 may also be provided. In this embodiment, upper supports 1157 are not being used. Such supports 1157 may, however, be used to support another tensioning system 1100 to provide additional reinforcement members. For example, the illustrated tensioning system 1100 may support two reinforcement members 1114, but four total reinforcement members could be used by also using a similar tensioning system 1110 with the upper set of supports 1157. Of course, tensioning system 1100 could also be moved to an upper set of supports such that only an upper set of supports is used at any given time.

FIG. 11B illustrates a tensioning system 1100 that is substantially identical to that of FIG. 11A, but from an overhead view. In particular, FIG. 11B illustrates a structure 1102 that includes a beam 1105 to which a tensioning system 1100 is attached for tensioning multiple elongated reinforcement members 1114. In the embodiment in FIG. 11B, there are also multiple supports 1157, nuts 1155, stressing bolts 1156, and anchor blocks 1110 used, although it will be appreciated in view of the disclosure herein that more or fewer may be used as desired. For example, there may be only a single anchor block 1110, and that single anchor block 1100 may connect to one or more reinforcement members 1114. There may also be three or more anchors and/or elongated reinforcement members 1114.

As noted in the discussion related to FIG. 11A, anchor blocks 1110 may connect directly to tube 1152 or may be connected through one or more intermediate members. In FIG. 11A an intermediate plate 1153 is used. However, to emphasize the optional nature of such a component, FIG. 11B illustrates that tensioning system 1100 can be used without such intermediate components.

Another optional feature is illustrated in FIG. 11B. As shown therein, an optional guide 1158 is positioned between nuts 1155. There may also be a similar guide between nuts on the bottom of tube 1152. Guide 1158 can be secured to plate 1150 by, for example, welding it thereto. Guide 1158 may then remain stationary as bolts 1156 are tightened and tube 1152 moves. In connection with supports 1157, guide 1158 may therefore direct the movement of tube 1152. Additionally, as bolts 1156 are tightened, torque is applied and a corresponding torque can be transferred to nuts 1155. Guide 1158 may also extend between two nuts 1155 to support nuts 1155 to minimize the risk of nuts 1155 becoming dislodged while tightening bolts 1156.

FIG. 11B shows tensioning system 1100 in a tensioned state such that an axial tension is placed on elongated reinforcement members 1114. The amount of tension placed on elongated reinforcement members 1114 can vary from application to application, as can measurement of the strain on reinforcement members 1114. For example, a different amount of tension may be placed depending on the strength of elongated reinforcement members 1114. Additionally, tension can be measured by merely measuring the displacement of tube 1152 from plate 1150, by using a linear variable differential transformer (LVDT), or even more directly by placing a strain gauge on elongated reinforcement members 1114. Once the desired tension is applied, tensioning system 1100 may be left as shown in FIG. 11B. Alternatively, a shim (not shown) may also be used. For example, a block of steel or other material may be positioned between plate 1150 and tube 1152. If the material has a width that is the same as the displacement distance, bolts 1156 may then be released and the shims may carry the compressive force exerted due to the tension on elongated reinforcement members 1114.

As will be appreciated by one skilled in the art in view of the disclosure herein, the embodiments disclosed and learned from the review of the description provided can be used to obtain a number of features useful for applications in reinforcing structures such as bridges, buildings, walls, and/or pipelines to name a few particular examples. For example, anchoring systems disclosed herein provide anchors that can be produced relatively cheaply and in any of a variety of different materials. For example, anchor blocks can be produced from steel, and may include even mild steel. Moreover, the steel may exhibit corrosion resistant properties so that it can be used even in harsh climates or in coastal climates. Additionally, the size of the anchors and/or tensioning systems herein can be implemented such that anchoring, splicing, and/or reinforcing can be provided in restricted areas. Indeed, whereas other applications may require large and/or expensive equipment (e.g., a hydraulic actuator attached to an elongated reinforcement member so as to provide a desired tension), example embodiments disclosed herein can apply a tension and clamp to a reinforcement member with relative ease (e.g., by merely tightening a few fastening devices). Thus, various disclosed embodiments can internally apply a tension without the use of external equipment, and without the need for large spaces to accommodate such equipment.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

More specifically, while illustrative exemplary embodiments of the invention have been described herein, the present invention is not limited to these embodiments, but includes any and all embodiments having modifications, omissions, combinations (e.g., of aspects across various embodiments), adaptations and/or alterations as would be appreciated by those in the art based on the foregoing detailed description. The limitations in the claims are to be interpreted broadly based on the language employed in the claims and not limited to examples described in the foregoing detailed description, which examples are to be construed as nonexclusive. Moreover, any steps recited in any method or process claims may be executed in any order and are not limited to the order presented in the claims, unless otherwise stated in the claims. Accordingly, the scope of the invention should be determined solely by the appended claims and their legal equivalents, rather than by the descriptions and examples given above.

What is claimed is:

1. An anchor system comprising:

a front-end surface configured to face a static structure;

at least one bore extending in an axial direction and generally perpendicular to said front-end surface;

a fibre reinforced polymer (FRP) rod disposed within said at least one bore;

a clamp side surface having a plurality of clamping holes formed therein, said plurality of clamping holes including at least four openings equally spaced along an axial length of the anchor system and being formed to extend such that said plurality of clamping holes are substantially parallel to said front-end surface;

a plurality of axial slits extending from said front-end surface to said at least one bore, said plurality of axial slits including at least an intermediate slit and two external slits, said plurality of axial slits forming at least two clamping members; and a plurality of fasteners including at least four substantially identical fasteners positioned in said clamping holes and adapted to clamp said at least two clamping members together, wherein clamping said at least two clamping members together contracts said at least one bore, and wherein said plurality of fasteners are offset from said front-end surface such that as said plurality of fasteners are clamped to said at least two clamping members, a taper is formed wherein said bore and said axial slit are larger at said front-end surface and decrease in size towards a back-end surface.

2. The anchor system of claim 1, at least one of said plurality of fasteners includes a clamping bolt and a nut connected to said clamping bolt.

3. An anchor system comprising:

a front-end surface configured to face a static structure;

at least one bore extending in an axial direction and generally perpendicular to said front end surface;

a clamp side surface having a plurality of clamping holes formed therein, said plurality of clamping holes being formed to extend such that said plurality of clamping holes are substantially parallel to said front-end surface;

a plurality of axial slits extending from said front-end surface to said at least one bore, said plurality of axial slits including at least an intermediate slit and two external slits, said plurality of axial slits forming at least two clamping members;

a plurality of fasteners positioned in said clamping holes and adapted to clamp said at least two clamping members together, wherein clamping said at least two clamping members together contracts said at least one bore, and wherein said plurality of fasteners are offset from said front-end surface such that as said plurality of fasteners are clamped to said at least two clamping members, a taper is formed wherein said bore and said axial slit are larger at said front-end surface and decrease in size towards a back-end surface;

a first elongated reinforcement member inserted within said at least one bore, said first elongated reinforcement member having a first end; and a second elongated reinforcement member inserted within said at least one bore, said second elongated reinforcement member being at least parallel to said first elongated member, wherein said plurality of fasteners exert a clamping force on said at least two clamping members to secure both of said first and second elongated reinforcement members within said at least one bore.

4. The anchor system of claim 3, wherein the plurality of fasteners includes at least one of a bolt, a screw, a lever cam, and a locking pin.

5. Au anchor system for imparting a compressive stress into a static structure, comprising:

a front-end surface configured to lace a static structure;

at least one bore extending in an axial direction and generally perpendicula to said front-end surface, wherein said bore has a tapered opening proximate said front-end surface, said tapered opening decreasing in size from said front-end surface;

a fibre reinforced polymer (FRP) rod disposed within said at least one bore;

a clamp side surface having a plurality of clamping holes formed therein, said plurality of clamping holes including at least four openings equally spaced along an axial length of the anchor system and being formed to extend such that said plurality of clamping holes are substantially parallel to said front-end surface;

a plurality of axial slits extending from said front-end surface to said at least one bore, said plurality of axial slits including at least an intermediate slit and two external slits, said plurality of axial slits forming at least two clamping members; and a plurality of fasteners including at least four substantially identical fasteners positioned in said clamping holes and adapted to clamp said at least two clamping members together, wherein clamping said at least two clamping members together contracts said at least one bore.

6. The anchor system of claim 5, wherein at least one of the plurality of axial slits include a neck portion, said neck portion being connected to said at least one axial bore.

7. An anchor system comprising:

a front-end surface configured to face a static structure;

at least one bore extending in an axial direction and generally perpendicular to said front-end surface, wherein said bore has a tapered opening proximate said front-end surface, said tapered opening decreasing in size from said front-end surface;

a clamp side surface having a plurality of clamping holes formed therein, said plurality of clamping holes being formed to extend such that said plurality of clamping holes are substantially parallel to said front-end surface;

a plurality of axial slits extending from said front-end surface to said at least one bore, said plurality of axial slits including at least an intermediate slit and two external slits, said plurality of axial slits forming at least two clamping members;

a plurality of fasteners positioned in said clamping holes and adapted to clamp said at least two clamping members together, wherein clamping said at least two clamping members together contracts said at least one bore;

a first elongated reinforcement member inserted within said at least one bore, said first elongated reinforcement member having a first end; and a second elongated reinforcement member inserted within said at least one bore, said second elongated reinforcement member being at least parallel to said first elongated member, wherein said plurality of fasteners exert a clamping force on said at least two clamping members to secure both of said first and second elongated reinforcement members within said at least one bore.

* * * * *